US012207730B2

(12) United States Patent
Rong

(10) Patent No.: US 12,207,730 B2
(45) Date of Patent: Jan. 28, 2025

(54) HEIGHT ADJUSTABLE ANGLED DESKS

(71) Applicants: Qidong Vision Mounts Manufacturing Co., Ltd., Nantong (CN); CKnapp Sales, Inc., Goodfield, IL (US)

(72) Inventor: Lu Hai Rong, Shanghai (CN)

(73) Assignee: CKnapp Sales, Inc., Goodfield, IL (US)

( * ) Notice: Subject to any disclaimer, the term of this patent is extended or adjusted under 35 U.S.C. 154(b) by 0 days.

(21) Appl. No.: 17/992,710

(22) Filed: Nov. 22, 2022

(65) Prior Publication Data

US 2024/0008635 A1 Jan. 11, 2024

(30) Foreign Application Priority Data

Jul. 8, 2022 (CN) ..... 202221765766.5

(51) Int. Cl.
*A47B 9/04* (2006.01)

(52) U.S. Cl.
CPC ..... *A47B 9/04* (2013.01); *A47B 2009/043* (2013.01); *A47B 2009/046* (2013.01); *A47B 2200/002* (2013.01); *A47B 2200/0057* (2013.01)

(58) Field of Classification Search
CPC ..... A47B 9/04; A47B 2009/043; A47B 2009/046; A47B 2200/002; A47B 2200/0057
USPC ..... 108/106
See application file for complete search history.

(56) References Cited

U.S. PATENT DOCUMENTS

| | | | | |
|---|---|---|---|---|
| 6,935,250 | B1 | 8/2005 | Arnold | |
| 8,104,410 | B2 * | 1/2012 | Lanfear | A47B 9/20 108/157.1 |
| 8,256,359 | B1 | 9/2012 | Agee | |
| 8,967,054 | B2 | 3/2015 | Henriott et al. | |
| 9,591,919 | B2 | 3/2017 | Ergun et al. | |
| 9,723,916 | B2 | 8/2017 | Chen | |
| 9,723,920 | B1 * | 8/2017 | Wu | H02K 7/06 |
| 9,848,696 | B2 | 12/2017 | Tseng | |
| 10,148,153 | B2 * | 12/2018 | Wu | H02K 7/1166 |

(Continued)

FOREIGN PATENT DOCUMENTS

| | | | |
|---|---|---|---|
| DE | 19600364 | A1 | 8/1996 |
| EP | 3440958 | A1 | 2/2019 |

(Continued)

*Primary Examiner* — Daniel J Troy
*Assistant Examiner* — Timothy M Ayres
(74) *Attorney, Agent, or Firm* — HANLEY, FLIGHT & ZIMMERMAN, LLC

(57) ABSTRACT

Height adjustable angled desks are disclosed herein. An example height adjustable table includes three legs, each of the three legs including an upper section, a lower section, and an actuator; a connection system to couple the three legs; a height adjust system including drive system; a first gearbox coupled to the drive system; second gearboxes coupled to respective ones of the actuators, the first gearbox and the second gearboxes to change a transmission direction; and transmission shafts connected to the drive system and to the first and second gearboxes; and wherein the drive system is configured to drive the transmission shafts to drive the legs together to rise and fall, and wherein the drive system includes a motor, a worm connected to the motor, and a worm wheel engaged with the worm.

21 Claims, 12 Drawing Sheets

(56) References Cited

U.S. PATENT DOCUMENTS

| | | | | |
|---|---|---|---|---|
| 10,271,642 | B1 | 4/2019 | Lin | |
| 10,349,737 | B2 | 7/2019 | Keller et al. | |
| 10,436,242 | B2 * | 10/2019 | Hu | B66F 3/10 |
| 10,531,732 | B1 * | 1/2020 | Huang | F16B 7/14 |
| 10,555,602 | B1 * | 2/2020 | Lu | A47B 9/04 |
| 10,758,039 | B2 * | 9/2020 | Allen | F16H 25/20 |
| 10,791,826 | B2 | 10/2020 | Crowe et al. | |
| 10,842,258 | B2 | 11/2020 | Applegate et al. | |
| 11,166,546 | B2 | 11/2021 | Lin | |
| 11,357,320 | B2 | 6/2022 | Jørgensen | |
| 11,596,221 | B2 * | 3/2023 | Lin | A47B 9/04 |
| 11,696,637 | B2 * | 7/2023 | Lin | A47B 9/04 108/144.11 |
| 2012/0227522 | A1 * | 9/2012 | Wu | F16H 25/20 74/89.14 |
| 2017/0188698 | A1 | 7/2017 | Chen et al. | |
| 2018/0103753 | A1 | 4/2018 | Davidsen | |
| 2018/0110325 | A1 | 4/2018 | Oberndörfer | |
| 2020/0154876 | A1 | 5/2020 | Liu | |
| 2022/0338617 | A1 | 10/2022 | Höglund | |
| 2023/0272845 | A1 * | 8/2023 | Rasmussen | F16H 25/2021 74/89.38 |

FOREIGN PATENT DOCUMENTS

| | | | |
|---|---|---|---|
| EP | 3172989 | B1 | 3/2021 |
| EP | 3282892 | B1 | 3/2022 |
| KR | 20150101797 | A | 9/2015 |
| SE | 1951289 | A1 | 5/2021 |
| WO | 2016166109 | A1 | 10/2016 |

* cited by examiner

HEIGHT ADJUSTABLE ANGLED DESKS

CROSS-REFERENCE TO RELATED APPLICATIONS

This patent claims benefit to Chinese Utility Model Application Serial No. 202221765766.5, which was filed on Jul. 8, 2022. Chinese Utility Model Application Serial No. 202221765766.5 is hereby incorporated herein by reference in its entirety. Priority to Chinese Utility Model Application Serial No. 202221765766.5 is hereby claimed.

FIELD OF THE DISCLOSURE

This disclosure relates generally to tables and, more particularly, to a height adjustable angled desk.

BACKGROUND

In recent years, people have grown increasingly concerned with risks stemming from prolonged periods of sitting. Prolonged sitting has been associated with a number of health concerns, such as increased risk of heart disease, stroke, diabetes, and premature death, and overall deconditioning of the human body, including early muscle fatigue, back pain, and spinal issues. Standing desks and height adjustable desks have become popular alternatives to traditional sitting desks because they allow user to stand while utilizing the desk's surface. A standing desk is a desk that is of sufficient height to enable a user to utilize the desk while in a standing (e.g., upright) position, whereas a height adjustable desk is a desk that allows the user to transition between a sitting position and a standing position by adjusting a height of the adjustable desk.

Figure 1A:
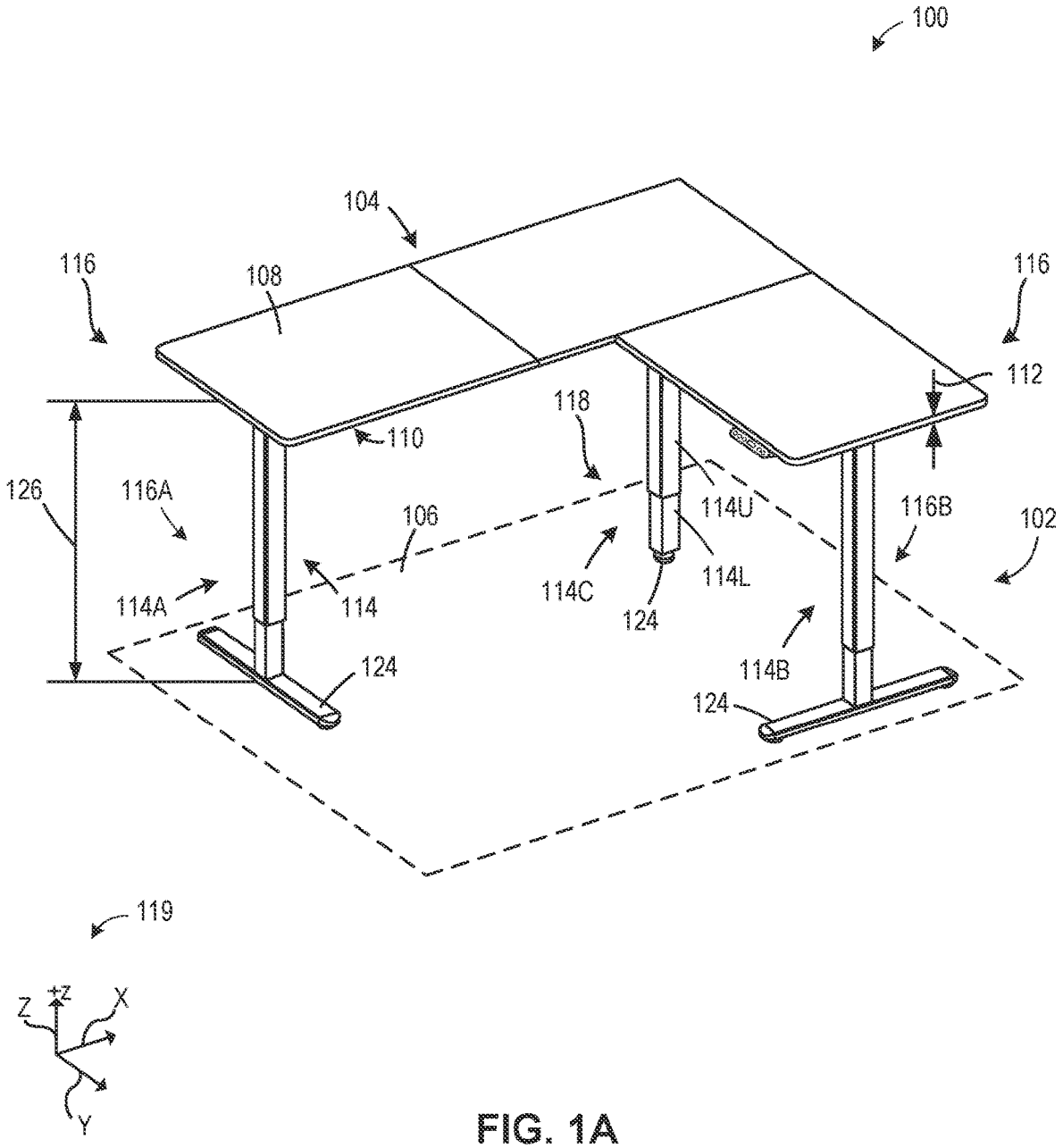
FIG. 1A illustrates an example height adjustable desk constructed in accordance with teachings of this disclosure.

In general, the same reference numbers will be used throughout the drawing(s) and accompanying written description to refer to the same or like parts. The figures are not to scale. Instead, the thickness of the layers or regions may be enlarged in the drawings. Although the figures show layers and regions with clean lines and boundaries, some or all of these lines and/or boundaries may be idealized. In reality, the boundaries and/or lines may be unobservable, blended, and/or irregular.

As used herein, unless otherwise stated, the term "above" describes the relationship of two parts relative to Earth. A first part is above a second part, if the second part has at least one part between Earth and the first part. Likewise, as used herein, a first part is "below" a second part when the first part is closer to the Earth than the second part. As noted above, a first part can be above or below a second part with one or more of: other parts therebetween, without other parts therebetween, with the first and second parts touching, or without the first and second parts being in direct contact with one another.

As used in this patent, stating that any part (e.g., a layer, film, area, region, or plate) is in any way on (e.g., positioned on, located on, disposed on, or formed on, etc.) another part, indicates that the referenced part is either in contact with the other part, or that the referenced part is above the other part with one or more intermediate part(s) located therebetween.

As used herein, connection references (e.g., attached, coupled, connected, and joined) may include intermediate members between the elements referenced by the connection reference and/or relative movement between those elements unless otherwise indicated. As such, connection references do not necessarily infer that two elements are directly connected and/or in fixed relation to each other. As used herein, stating that any part is in "contact" with another part is defined to mean that there is no intermediate part between the two parts.

Unless specifically stated otherwise, descriptors such as "first," "second," "third," etc., are used herein without imputing or otherwise indicating any meaning of priority, physical order, arrangement in a list, and/or ordering in any way, but are merely used as labels and/or arbitrary names to distinguish elements for ease of understanding the disclosed examples. In some examples, the descriptor "first" may be used to refer to an element in the detailed description, while the same element may be referred to in a claim with a different descriptor such as "second" or "third." In such instances, it should be understood that such descriptors are used merely for identifying those elements distinctly that might, for example, otherwise share a same name.

As used herein, "approximately" and "about" modify their subjects/values to recognize the potential presence of variations that occur in real world applications. For example, "approximately" and "about" may modify dimensions that may not be exact due to manufacturing tolerances and/or other real world imperfections as will be understood by persons of ordinary skill in the art. For example, "approximately" and "about" may indicate such dimensions may be within a tolerance range of +/−10% unless otherwise specified in the below description.

Various terms are used herein to describe the orientation of features. In general, the attached figures are annotated with a set of axes including the x-axis X, the y-axis Y, and the z-axis Z. As disclosed herein, the z-axis runs orthogonal relative to a surface on which the desk resides.

"Including" and "comprising" (and all forms and tenses thereof) are used herein to be open ended terms. Thus, whenever a claim employs any form of "include" or "comprise" (e.g., comprises, includes, comprising, including, having, etc.) as a preamble or within a claim recitation of any kind, it is to be understood that additional elements, terms, etc., may be present without falling outside the scope of the corresponding claim or recitation. As used herein, when the phrase "at least" is used as the transition term in, for example, a preamble of a claim, it is open-ended in the same manner as the term "comprising" and "including" are open ended. The term "and/or" when used, for example, in a form such as A, B, and/or C refers to any combination or subset of A, B, C such as (1) A alone, (2) B alone, (3) C alone, (4) A with B, (5) A with C, (6) B with C, or (7) A with B and with C. As used herein in the context of describing structures, components, items, objects and/or things, the phrase "at least one of A and B" is intended to refer to implementations including any of (1) at least one A, (2) at least one B, or (3) at least one A and at least one B. Similarly, as used herein in the context of describing structures, components, items, objects and/or things, the phrase "at least one of A or B" is intended to refer to implementations including any of (1) at least one A, (2) at least one B, or (3) at least one A and at least one B. As used herein in the context of describing the performance or execution of processes, instructions, actions, activities and/or steps, the phrase "at least one of A and B" is intended to refer to implementations including any of (1) at least one A, (2) at least one B, or (3) at least one A and at least one B. Similarly, as used herein in the context of describing the performance or execution of processes, instructions, actions, activities and/or steps, the phrase "at least one of A or B" is intended to refer to implementations including any of (1) at least one A, (2) at least one B, or (3) at least one A and at least one B.

As used herein, singular references (e.g., "a", "an", "first", "second", etc.) do not exclude a plurality. The term "a" or "an" object, as used herein, refers to one or more of that object. The terms "a" (or "an"), "one or more", and "at least one" are used interchangeably herein. Furthermore, although individually listed, a plurality of means, elements or method actions may be implemented by, e.g., the same entity or object. Additionally, although individual features may be included in different examples or claims, these may possibly be combined, and the inclusion in different examples or claims does not imply that a combination of features is not feasible and/or advantageous.

DETAILED DESCRIPTION

In recent years, standing desks have gained popularity due to the ergonomic and/or health benefits such desks provide to a user. While standing desks are a healthier alternative to traditional sitting desks, continuous standing is often an undesirable alternative to continuous sitting. As such, adjustable (e.g., convertible, sit-to-stand, lift, height adjustable) desks/tables continue to gain popularity amongst desk users. Height adjustable desks provide a great benefit to users who desire to alternate between sitting and standing within any given day. Height adjustable desks allow the user to adjust the height of a desktop, enabling a user to work alternately between sitting and standing positions to reduce potential harm to the human body caused by prolonged sitting. In some examples, the height adjustable desk enables improved work efficiency. As more people have schoolwork, careers, and/or other activities that require continuous use of a computer, demand for height adjustable desks will continue to increase.

A height adjustable desk typically includes a plurality of adjustable legs (e.g., bars, columns, arms, etc.) that support a desktop (e.g., tabletop, table board, etc.) and a height adjustment mechanism to enable height adjustment of the desk. The height adjustable desk may be a desk converter (e.g., a small table) that is designed to be placed on another table surface (e.g., another desk, table, etc.) or a larger standalone (e.g., free standing) desk. The height adjustment system may be powered manually, such as using a lever that releases a pneumatic mechanism to allow the desk to be pushed to a desired position (common with desk converters) or a crank that moves the desk to various heights, or could be electronic, such as an input interface having inputs to allow the user to move the desk up or down or move the desk to saved heights.

In recent years, demand for larger-sized desks has increased, leading to an increased demand for L-shaped height adjustable desks. An L-shaped height adjustable desk can include an angled desktop resulting in a larger workspace. The L-shaped desk height adjustable desk typically includes three retractable (e.g., telescopic) legs that are driven by three respective motors to raise or lower the height adjustable desk. However, simultaneous operation of three or more motors results in a high level of noise, which is inconvenient to people in an environment in which the height adjustable desk resides. Further, control is difficult due to at least the precise requirements for synchronizing the three or more motors.

Examples disclosed herein enable manufacture of a height adjustable desk (e.g., table) that includes a single drive system (e.g., assembly) configured to synchronously adjust a length of at least three telescoping legs (e.g., lift columns). Example height adjustable desks disclosed herein include a desktop coupled to the telescoping legs. Example telescoping legs disclosed herein include actuators to enable lengthening and shortening of the telescoping legs to cause height adjustment of the example desktop. As such, the height of the adjustable desk can be varied.

Example height adjustable desks disclosed herein include a height adjustment system that includes a drive system having a motor coupled to a worm gear assembly. Certain example height adjustment systems include gearboxes coupled to the actuators and/or the drive system and transmission shafts structured to couple the gearboxes to the drive system. Example height adjustable desks disclosed herein provide for synchronous height adjustment of three or more telescoping legs through the cooperation of the drive system, the gearboxes, and the transmission shafts.

Certain example height adjustable desks disclosed herein thus reduce a cost of height adjustment by utilizing a single motor to power three legs as opposed to three separate motors each powering an individual leg. Certain example height adjustable desks improve the synchronization and accuracy of control during operation by providing height adjustment of three separate legs with one drive system.

Example height adjustable desks disclosed herein enable a reduced noise level of the height adjustable desk. For example, utilizing a single motor as opposed to three separate motors results in reduced noise caused by a motor(s). Certain examples utilize a silent motor to further reduce a noise level. Certain examples provide for rotation transmission using an example worm gear assembly to enable reduced noise of height adjustable desk.

Certain example height adjustable desks are configurable, enabling different arrangements of the height adjustable desk. Such structural arrangement is not only convenient for installation and transportation, but also convenient for customers to install and use in different environments.

Figure 1B:
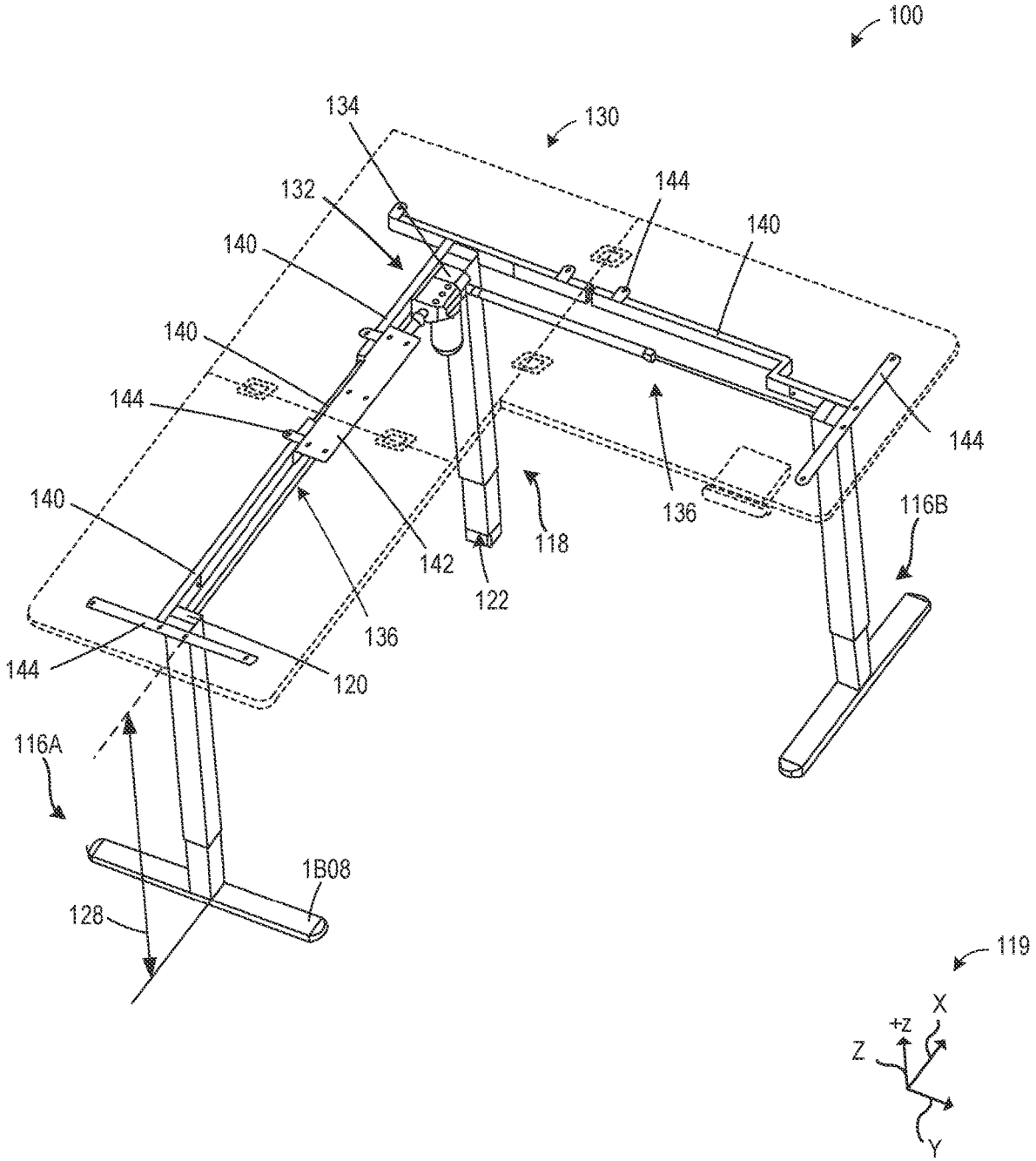
FIG. 1B is a perspective view of the example height adjustable desk of FIG. 1A including an example height adjustment system having a single motor to drive three legs in accordance with teachings of this disclosure.
Figure 1C:
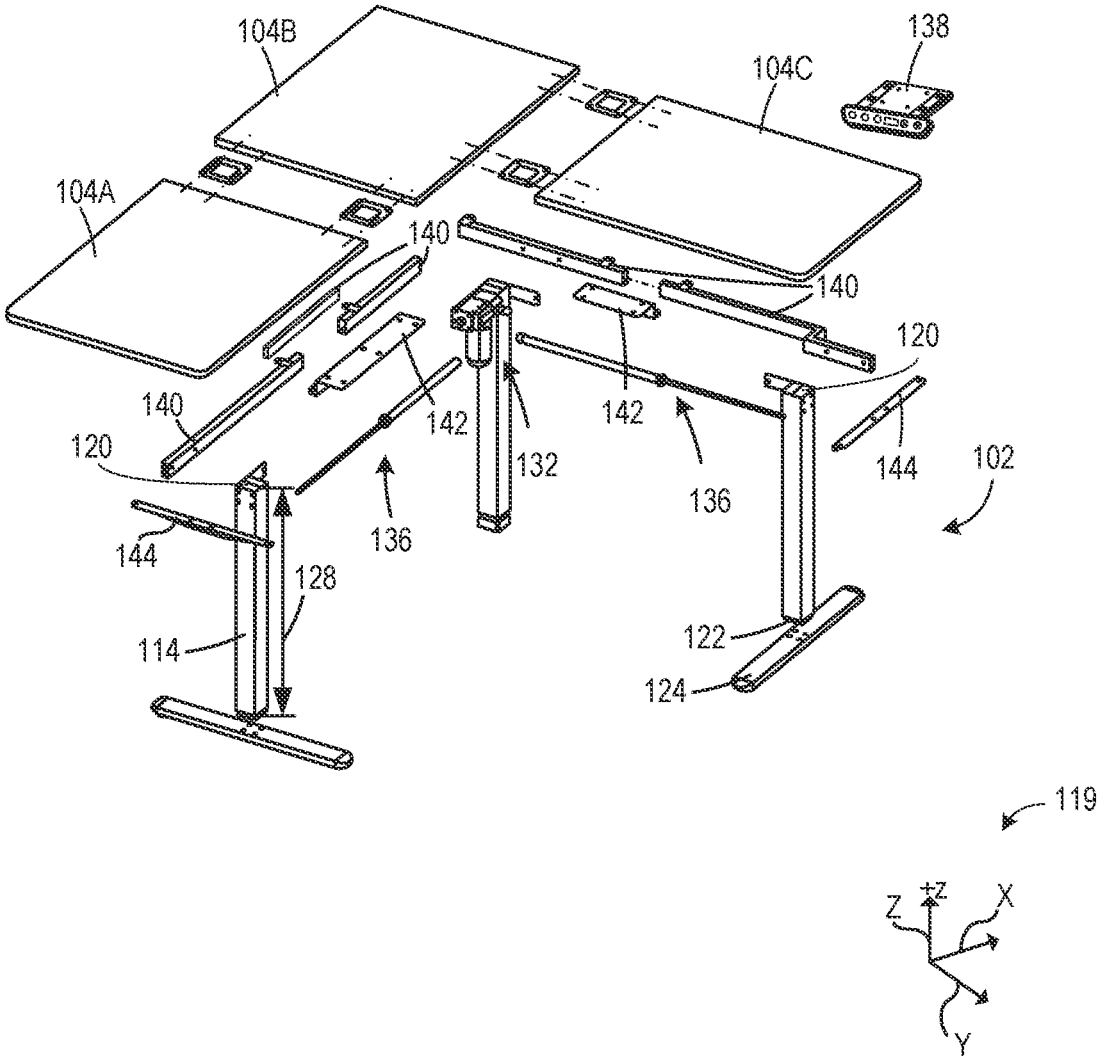
FIG. 1C is an exploded view of the example height adjustable desk and the example height adjustment system of FIGS. 1A-1B in accordance with teachings of this disclosure.

FIGS. 1A-1C illustrate an example height adjustable desk 100 (e.g., convertible desk, lift table, sit-to-stand desk/table, etc.) structured in accordance with teachings of this disclosure to provide an angled, height adjustable work surface (e.g., workstation) using a single drive mechanism. FIG. 1A is a perspective view of the example height adjustable desk 100, which includes an example adjustable base frame (e.g., desk frame) 102 and an example desktop (e.g., tabletop, table board, etc.) 104 removably coupled to the base frame 102 (illustrated in greater detail in FIGS. 1B-1C). In some examples, the base frame 102 and the desktop 104 implement structural means. The height adjustable desk 100 may be positioned on an example floor (e.g., support surface) 106. The floor 106 can be any suitable surface that can hold or otherwise support the height adjustable desk 100 such as, but not limited to, the ground, a platform, hardwood floor, carpet, tile, etc.

The desktop 104 includes an example first (e.g., top) surface 108 and an example second (e.g., bottom) surface 110, and is associated with an example desktop thickness 112 defined by a distance between the first and second surfaces 108, 110. The top surface 108 provides a work surface on which a user can place objects. For example, the user may position a computer, printer, keyboard, mouse, papers, and/or any other objects on the top surface 108. The bottom surface 110 faces towards the floor 106 and interfaces with the base frame 102. In some examples, the desktop thickness 112 is approximately 1 inch, but can be thicker or thinner in other examples.

The base frame 102 provides structural support for the height adjustable desk 100. The base frame 102 of FIGS. 1A-1C includes three example telescoping legs 114 (e.g., retractable legs, lift columns etc.) that carry and support the desktop 104. The telescoping legs 114 of FIGS. 1A-1C are vertical columns positioned substantially orthogonal relative to the floor 106, but may be associated with an angle in some examples. Each telescoping leg(s) 114 includes two or more example telescoping leg sections, such as an example upper (e.g., outer) section 114U and an example lower (inner) section 114L. Such a configuration enables the upper section(s) 114U of the telescoping leg(s) 114 to slide relative to the lower section(s) 114L, allowing the telescoping leg(s) 114 to change length.

In the illustrated example of FIG. 1A, the telescoping legs 114 are arranged in an L-shaped format to provide support for an L-Shaped desktop 104. For example, an example first telescoping leg 114A and an example second telescoping leg 114B of the three telescoping legs 114 may be positioned at example end points 116 of the height adjustable desk 100 and an example third telescoping leg 114C of the three telescoping legs 114 may be positioned at an example point of interconnection 118 (e.g., interconnection point). In some examples, the first telescoping leg 114A implements an example first end point 116A. In some examples, the second telescoping leg 114B implements an example second end point 116B. In some examples, the first leg 114C implements the point of interconnection 118.

In some examples, the lower section 114L of the telescoping leg 114C at the point of interconnection 118 defines an example set of coordinates 119 that includes the x-axis X, the y-axis Y, and the z-axis Z. In illustrated examples disclosed herein, the z-axis is defined to run parallel relative to a length of the lower section 114L of the telescoping leg 114C. The x-axis is defined to run parallel to a direction of the point of interconnection to the first end point 116A, and the y-axis is defined to run parallel to a direction of the point of interconnection 118 to the second end point 116B. However, the coordinates 119 may be defined differently in additional or alternative examples.

The end points 116A, 116B extend in different directions relative to the point of interconnection 118 such that the desktop 104 defines a substantially right angle. Such an arrangement enables the top surface 108 to be larger relative to traditional desks with two legs, enabling higher space utilization. For example, positioning the height adjustable desk 100 in a corner of a room can increase an amount of leg space under the height adjustable desk 100 and an amount of desk workspace on the top surface 108. However, the height adjustable desk 100 can be configured in other structural forms apart from the L-shape. For example, the height adjustable desk 100 can include more telescoping legs 114 as needed or desired to extend the area of the desktop 104. In some examples, the desktop 104 can define a different angle and/or be associated with another shape.

Each telescoping leg 114A-C includes an example first (e.g., top) end 120 (illustrated in FIGS. 1B and 1C) that is to interface with the desktop 104 and an example second (e.g., bottom) end 122 (illustrated in FIG. 1C) that is to interface with the floor 106. In some examples, the bottom end(s) 122 is provided with example an example base support(s) 124 such as (but not limited to) a foot, a foot pad, a castor wheel, etc., at least in part to increase a level of stability of the height adjustable desk 100. The base support(s) 124 may be positioned between the second end(s) 122 of the leg telescoping leg(s) 114A-C and the floor 106. In some examples, the base support(s) 124 may be coupled to or otherwise include an additional base support(s) 124. For example, a base support(s) 124 in the form of a foot may include a pad(s) to prevent or otherwise limit damage to the floor 106 or a castor(s) to enable easy transport of the height adjustable desk 100 from a first location to a second location.

The height adjustable desk 100 is associated with an example desk height 126 (illustrated in FIG. 1A) measured from a lowermost point of the telescoping leg(s) 114A-C (e.g., a bottom end 122 of the telescoping leg(s) 114, a bottom of a base support 124, etc.) to the top surface 108 of the desktop 104. The telescoping legs 114A-C are associated with an example length 128 (illustrated in FIG. 1B) defined by a distance between the first ends 120 and respective second ends 122. Thus, the desk height 126 of the height adjustable desk 100 at a given moment in time may correspond to a length 128 of the telescoping legs 114A-C at the moment of time plus the desktop thickness 112 and a vertical size of a base support(s) 124. The telescoping legs 114A-C are adjustable columns. As noted above, each telescoping leg(s) 114A-C includes two or more telescoping leg sections 114U, 114L that enable the telescoping leg(s) 114A-C to extend and retract to change in length 128 and raise or lower the height adjustable desk 100. The height adjustment of the height adjustable desk 100 is implemented by simultaneously changing the lengths 128 of the telescoping legs 114A-C.

The height adjustable desk 100 includes an example height adjustment system 130, which is configured to cause the telescoping legs 114A-C to rise or fall substantially simultaneously (e.g., concurrently, all together, at the same time) to adjust the height 126 of the height adjustable desk 100 (e.g., from a sitting height to a standing height or vice versa). The height adjustment system 130 includes an example drive system 132, a plurality of example gearboxes 134 (illustrated in greater detail in FIG. 2), a plurality of example transmission shafts 136 (e.g., transmission rods, synchronous (sync) rods, tie rods, etc.), and a plurality of example actuators (e.g., actuator(s) 200 of FIG. 2). Through the gearboxes 134 and the transmission shafts 136, the drive system 132 supplies rotational motion to the actuators 200, which convert the rotational motion to linear motion to lengthen and shorten the telescoping legs 114 A-C. In some examples, the drive system 132 implements driving means.

In some examples, the height adjustment system 130 includes an example controller 138, which may be communicatively coupled to the drive system 132. For example, the controller 138 may be in communication with the drive system 132 through a wired and/or wireless (e.g., BLUETOOTH®, WIFI, cellular, etc.) connection. The controller 138 is configured to control the drive system 132 to control the height 126 of the height adjustable desk 100. The controller 138 may include an input interface, such as a touch screen, buttons, etc., that allow a user to adjust the height 126 of the height adjustable desk 100 up or down, save preset heights 126 for height 126 of the height adjustable desk 100, etc.

Each of the three telescoping legs 114A-C includes or otherwise implements a respective actuator 200. In some examples, the lower section(s) 114L of the telescoping legs 114A-C are configured to implement the actuators 200 and the upper section(s) 114U of the telescoping legs 114A-C implement cover(s) for the actuators 200. For example, each lower section(s) 114L may include a lead screw assembly (e.g., lead screw assembly 202 of FIG. B) that converts rotational motion provided by the drive system 132 into linear motion that drives the top ends 120 of the telescoping legs 114A-C in an upward or downward direction while the bottom ends 122 of the telescoping legs 114A-C remain stationary. As the telescoping legs 114A-C raise or lower, the desktop 104 coupled to the telescoping legs 114A-C raise or lower accordingly. An example implementation of the height adjustment system 130 of FIGS. 1A-1C is discussed in greater detail below in relation to FIGS. 2-6.

The height adjustment system 130 is coupled to the base frame 102, which includes an example connection system that enables connection of different components of the height adjustable desk 100. For example, the connection system enables the three telescoping legs 114A-C to be connected as a whole, forming an integrated unit to support the desktop 104. In some examples, the connection system provides increased support for the telescoping legs 114A-C, the desktop 104, the height adjustment system 130, and/or, more generally, the height adjustable desk 100. The connection system of FIG. 1B, components of which are illustrated in FIG. 1C, includes a plurality of example crossbar(s) (e.g., cross beams, connection rods, etc.) 140, an example crossbar connector(s) (e.g., bracket) 142, and example mounting brackets 144. However, the connection system can include more or less components and/or different components in additional or alternative examples.

The crossbars 140 of FIGS. 1B-1C are configured to couple the telescoping legs 114A-C to form a base structure for the desktop 104. The mounting brackets 144 configured to couple the desktop 104 to the base frame 102. In some examples, a crossbar connector 142 is used to couple two or more crossbars 140 and/or to provide increased structural support. For example, a first crossbar 140 may extend from a first telescoping leg 114A-C and a second crossbar 140 may extend from a second telescoping leg 114A-C, and the crossbar connector 142 may couple the first and second crossbars 140. In some examples, a single crossbar 140 may extend to couple two telescoping legs 114A-C.

In some examples, the crossbars 140 are telescopic such that a first crossbar 140 can nest within a second crossbar 140 at one end of the first crossbar 140 and to a third crossbar 140 at a second end of the first crossbar 140, enabling different configurations of the height adjustable desk 100 by adjustment of the crossbar(s) 140. For example, as illustrated in FIGS. 1A-1C, the desktop 104 may be spliced into three desktop sections 104A-C, which can be arranged in different configurations based on an arrangement of the connection system (discussed in further detail below in relation to FIGS. 7A-11).

As illustrated in FIG. 1B, the mounting bracket(s) 144 may be coupled the top end(s) 120 of the telescoping leg(s) 114A, 114B at the end point(s) 116 of the height adjustable desk 100 and/or adjacent thereto (e.g., a top of a side wall of the telescoping leg(s) 114). The mounting bracket(s) 144 of FIGS. 1B-1C are long, angled brackets, but may be of different structural forms in additional or alternative examples, such as (but not limited to) curbed brackets, Z-shaped brackets, etc. The desktop 104 is to be coupled to the mounting bracket(s) 144 (e.g., via screws, bolts, and/or other fastener) to connect the desktop 104 to the base frame 102. In some examples, the desktop 104 may be coupled to the base frame 102 at different example connection points and/or using different mechanisms. In some examples, the desktop 104 may be directly coupled to one or more telescoping legs 114A-C.

It is understood that the connection system can take on different configurations in other examples. In some examples, one or more components of the connection system may be integrally formed. Further, it is understood that the connection system may couple with the telescoping legs 114A-C in any suitable manner that enables adjust of the length(s) 128 of the telescoping legs 114A-C while providing support to the desktop 104.

Figure 2:
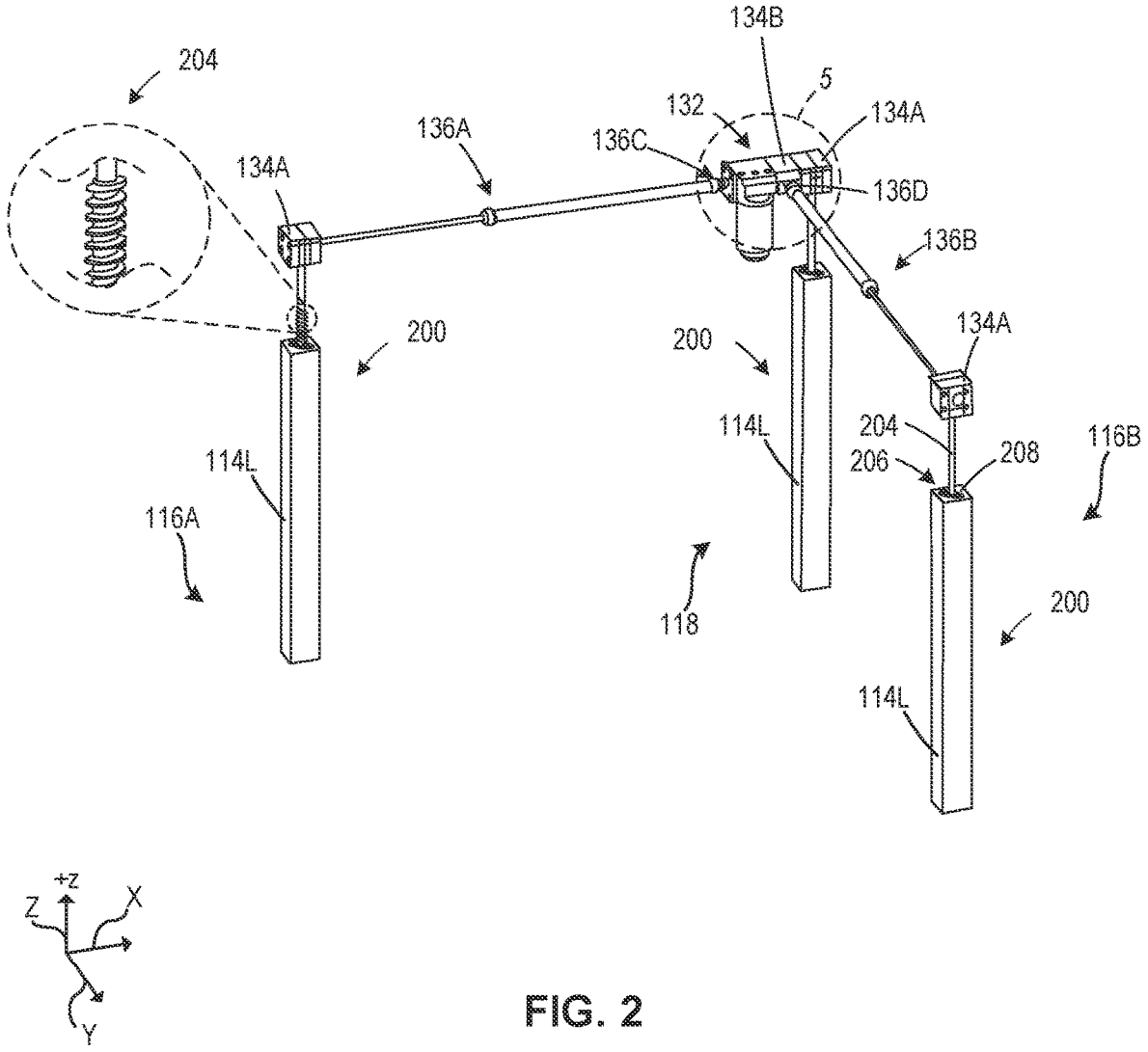
FIG. 2 is an isometric view of the example height adjustment system of FIGS. 1A-1C structured in accordance with teachings of this disclosure.

FIG. 2 illustrates a perspective view of the example height adjustment system 130 of FIGS. 1A-1C structured in accordance with teachings of this disclosure to simultaneously lengthen or shorten the telescoping legs 114A-C to raise or lower, respectively, the height adjustable desk 100. That is, the height adjustment system 130 is configured to cause the upper sections 114U (not illustrated in FIG. 2; illustrated in FIG. 6) of the telescopic legs 114A-C to raise and lower relative to the lower sections 114L to cause the desktop 104 to raise and lower, respectively. The height adjustment system 130 includes the example drive system 132, which is structured to provide rotational motion to the example actuators 200 through the gearboxes 134 and the transmission shafts 136.

In the illustrated example of FIG. 2, the drive system 132 is positioned adjacent the telescoping leg 114C at the interconnection point 118 and relative to the x axis. In other words, the drive system 132 of FIG. 2 is positioned adjacent the point of interconnection 118. However, the drive system 132 can be positioned adjacent in another location, such as the first end point 116A or the second end point 116B. The height adjustable desk 100 includes a single drive system 132 that is structured to provide rotational motion each of the three telescoping legs 114A-C. In some examples, such a configuration results in reduced noise relative to multi-drive system desks, thus improving user experience. In some examples, the drive system 132 provides improved accuracy of control during height adjustment of the height adjustable desk 100 by adjusting the telescoping legs 114A-C collectively (e.g., together, simultaneously, etc.) as a single unit.

As noted above, each of the three telescoping legs 114A-C includes or otherwise implements a respective actuator 200. In some examples, the actuators 200 implement actuator means. In the illustrated example of FIG. 2, each actuator(s) 200 includes a respective lower section(s) 114L and an example lead screw assembly 202 coupled to the respective lower section 114L. The lead screw assembly 202 includes an example threaded rod 204 and an example threaded nut 206. The threaded nut(s) 206 is coupled to an example top portion 208 of the lower section(s) 114L such that the threaded nut 206 remains at a stationary position relative to the z-axis. The threaded rod 204 extends through and rotatably couples to the threaded nut 206 such that a first portion of the threaded rod 204 extends into the lower section(s) 114L and a second portion of the threaded rod 204 extends upward (e.g., in the +z direction) from the lower section(s) 114L. It is noted, however, that the telescoping leg(s) 114A-C can include other mechanical actuators capable of converting rotational motion into linear motion in additional or alternative examples. Further, the telescoping legs 114A-C can be formed in any suitable manner that enables the telescoping legs 114A-C to simultaneously change in length 128 based on work provided by the drive system 132.

The telescoping legs 114A-C are movably coupled to the drive system 132 through the gearboxes 134 and the transmission shafts 136. The height adjustment system 130 includes the plurality of gearboxes 134, which may include three example first (e.g., leg) gearboxes 134A and an example second (e.g., interconnection) gearbox 134B. Each actuator 200 of the height adjustable system 130 is coupled to a respective leg gearbox 134A while the interconnection gearbox 134B is positioned adjacent and coupled to the leg gearbox 134A at the interconnection point 118. Thus, the height adjustment system 130 includes four gearboxes 134, each of which transmit motion through a single gear. The leg gearboxes 134A are configured to change horizontal transmission directions to a vertical transmission directions and the interconnection gearbox 134B is configured to change a first horizontal direction to a second horizontal direction.

In some such examples, the single-gear gearboxes 134A, 134B provide improved transmission accuracy. In some examples, the single-gear gearboxes 134A, 134B are quiet (e.g., compared to multi-gear gearboxes). In some examples, the single-gear gearboxes 134A, 134B may experience a longer life by reducing or other eliminating tooth gnashing and/or tooth dislocation caused by excessive gear meshing of multiple gears within the gearboxes 134A, 134B.

The example transmission shafts 136 are structured to transmit power/motion between components of the height adjustment system 130. In the illustrated example of FIG. 2, an example first transmission shaft 136A is coupled to and extends from a respective leg gearbox 134A at the first end point 116A and an example second transmission shaft 136B is coupled to and extends from a respective leg gearbox 134A at the second end point 116B. The first transmission shaft 136A of FIG. 2 extends along the x-axis from the respective leg gearbox 134A and couples to the drive system 132. However, the first transmission shaft 136A may couple to the interconnection gearbox 134B in additional or alternative examples (e.g., depending on a location of the drive system 132). Similarly, the second transmission 136B of FIG. 2 extends along the y-axis from the respective leg gearbox 134A and couples to the interconnection gearbox 134B. However, the second transmission shaft 136B may couple to the drive system 132 in additional or alternative examples (e.g., depending on a location of the drive system 132). The first and second transmission shafts 136A, 136B of FIG. 2 are sync rod(s), but may be any suitable type of transmission rod in other examples. The first and second transmission shafts 136A, 136B transmit rotational motion provided by the drive system 132 to the actuators 200 at the end points 116A, B through the action of respective leg gearboxes 134A.

The height adjustment system 130 includes an example output transmission shaft 136C (illustrated in FIGS. 4-5) that extends through the drive system 132. In some examples, the output transmission shaft 136C couples to the leg gearbox 134A at the interconnection point 118, providing a transmission path from the actuator 200 of the interconnection point 118 to the drive system 132. Further, the height adjustment system 130 includes an example interconnection transmission shaft 136D (illustrated in FIGS. 4-5) that extends from the interconnection gearbox 134B. In some examples, the first transmission shaft 136A couples to the output transmission shaft 136C, providing a transmission path from the actuator 200 of the first endpoint 116A to the drive system 132. In some examples, the second transmission shaft 136B couples to the interconnection transmission shaft 136D, providing a transmission path from the actuator 200 of the second endpoint 116B to the drive system 132.

In some examples, the leg gearboxes 134A, the interconnection gearbox 134B and/or, more generally, the gearboxes 134 implement gear means. In some examples, the first transmission shaft 136A, the second transmission shaft 136B, the output transmission shaft 136C, the interconnection transmission shaft 136D, and/or, more generally, the transmission shafts 136 implement transmission means.

Figure 3A:
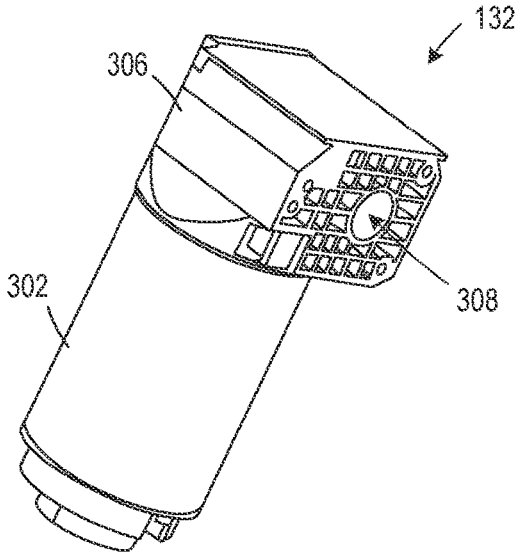
FIG. 3A is a perspective view of the example drive system of the height adjustable system of FIGS. 1B-1C.
Figure 3B:
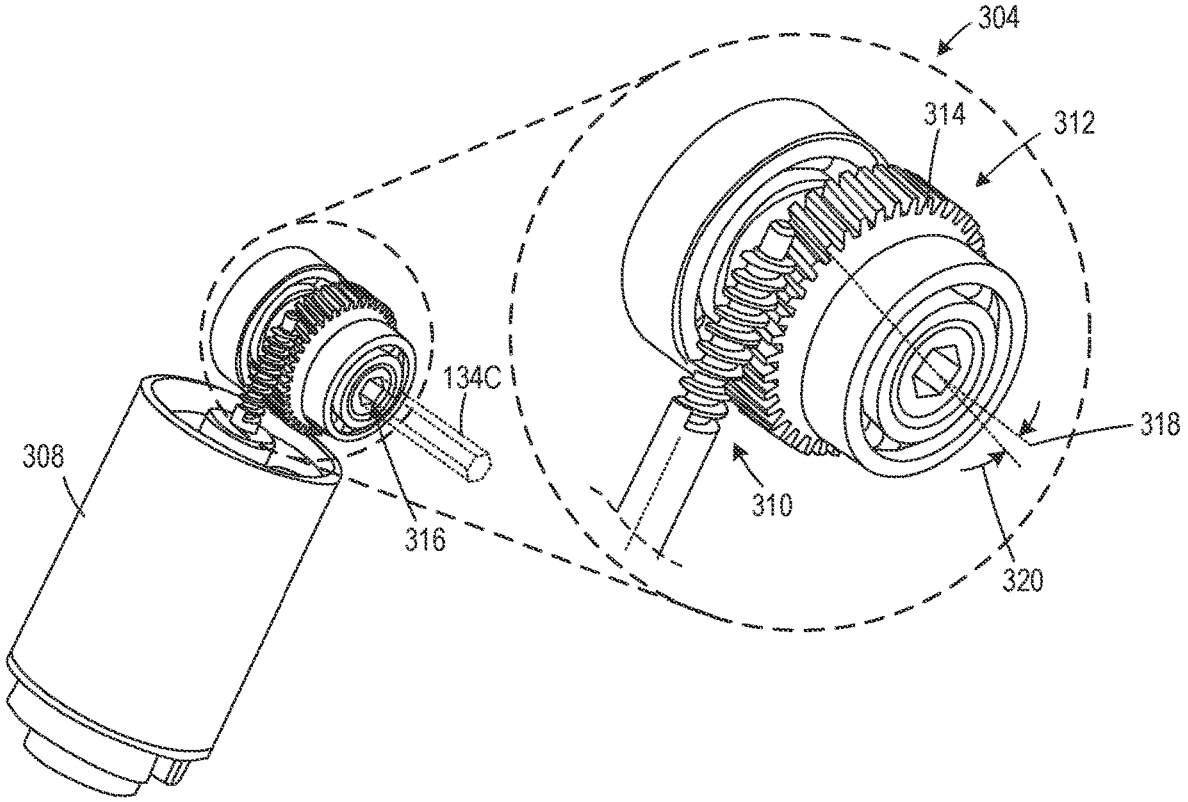
FIG. 3B illustrates another perspective view of the example drive system of FIG. 3A including an enlarged view of an example worm gear assembly configured in accordance with teachings of this disclosure.

FIGS. 3A and 3B illustrate a perspective view of the example drive system 132 FIGS. 1A-C and 2 structured in accordance with teachings of this disclosure to enable synchronous height adjustment of the three telescoping legs 114A-C through the cooperation of the example gearboxes 134A, 134B and the example transmission shafts 136A-D. In some examples, the drive system 132 enables accurate control of the three telescoping legs 114A-C to improve synchronization and reduces costs relative to traditional desks.

The drive system 132 includes an example motor 302 and an example worm gear assembly (e.g., worm gear, worm drive, etc.) 304 (illustrated in FIG. 3B). The motor 302 may be electric motor that is communicatively coupled to the example controller 138 of FIGS. 1A-1C. In some examples, the worm gear assembly 304 is positioned within an example cover 306, forming an example worm gearbox. In some examples, the worm gear assembly 304 and the cover 306 implement an example worm gearbox. The cover 306 includes an example aperture(s) 308 to retain the example output transmission shaft 136C. In some examples, the motor 302 is a silent motor to reduce an amount of noise generated by the height adjustable desk 100 during operation In the illustrated example of FIG. 3B, the cover 306 is removed to illustrate the worm gear assembly 304. The worm gear assembly 304 is a staggered shaft gear that transmits motion between two shafts that are neither intersecting nor parallel. The worm gear assembly 304 includes an example worm (e.g., worm screw) 310, and an example worm wheel (e.g., worm gear) 312 meshed with the worm 310. The worm 310 is a threaded rod rotatably coupled to the motor 302. The worm wheel 312 includes a plurality of teeth 314 that mesh with the threads of the worm 310. In operation, the rotation of the motor 302 causes the worm 310 to rotate, and the rotation of the worm 310 drives rotation of the worm wheel 312. In other words, the drive system 132 transmits rotational motion provided by the motor 302 in the form of a worm wheel and a worm, which reduces the operational noise of the motor 302.

The worm gear assembly 304 is compact, demanding fewer parts to provide a high speed reduction ratio (e.g., relative to other types of gears such as spur gears). The speed reduction (e.g., output rotational speed) provided by the worm gear assembly 304 is based on a number of threads in the worm 310 and a number of teeth 314 on the worm wheel 312. For example, the speed reduction (e.g., output rotational speed) provided by a single-start worm gear assembly 304 corresponds to a size of the worm-to-1 regardless of the size of the worm 310, because each 360° turn of the worm 310 causes the worm wheel 312 to advance by one tooth 314. In such an example, a 20-tooth worm wheel 312 reduces the speed of the motor 302 by a ratio of 20:1. Thus, unlike other gears that produce high pitched noises at high speeds, the worm gear assembly 304 is quiet.

The worm gear assembly 304 of FIG. 3 includes an example speed reduction ratio of the worm wheel 312 to the worm 310 of 20:1. Thus, the worm gear assembly 304 of FIG. 3 is relative quiet. In some examples, the relatively small speed reduction ratio of 20:1 results in a reduced rotation speed of the motor 302, which in turn reduces the noise emitted by the motor 302. However, the worm gear assembly 304 can include another speed reduction ration in additional or alternative examples.

The worm wheel 312 includes an example bore 316 through which the example output transmission shaft 136C (illustrated in FIG. 4) may extend. In operation, the worm 310 is the driving component that turns the worm wheel 312 and, resultingly, the output transmission shaft 136C. The worm gear assembly 304 of FIGS. 3A-3B is self-locking such that torque applied from the load side (e.g., the worm wheel 312) is blocked (e.g., cannot drive the worm 310). Accordingly, the output transmission shaft 136C is not able to drive rotation of the worm 310 through the worm wheel 312. Whether a worm gear assembly 304 is self-locking depends on a helix angle (e.g., lead angle) of the worm wheel 312, a pressure angle of the worm wheel 312, and the coefficient of friction between the worm wheel 312 and the worm 310. For example, a worm gear assembly 304 having a low helix angle may be self-locking.

The worm wheel 312 defines an example axis of rotation 318, which corresponds a length of the bore 316. The axis of rotation 318 is at a substantially right angle relative to the worm 310. The worm wheel 312 includes an example helix angle, which is defined by an angle between the axis of rotation 318 and an example line represented by a line that is tangent to a tooth 314. In some examples, the helix angle 320 is approximately between 9 and 12 degrees. However, the helix angle 320 can be larger or smaller in additional or alternative examples such that the work gear assembly 304 is self-locking. In the present disclosure, the helix angle 320 of the worm 310 is set such that an expansion helix angle of the worm 310 is smaller than a friction angle of the worm wheel 312 in contact with the worm 310. As a result, the pressure provided by the desktop 104 will not change cause the telescoping legs 114A-C to lower, which improves the reliability of the product and solves the problem of large load-bearing of the single motor.

In some examples, the worm 310 is formed of steel, and the worm wheel 312 is formed of a high-performance composite material (e.g., to further improve the self-locking capability). For example, the worm wheel 312 may be formed of a high-toughness engineering plastic, a nylon and glass fiber composite material, etc. Such materials may improve the friction between the worm 310 and the worm wheel 312 to improve the self-locking capability of the worm gear assembly 304 and/or to improve its reliability of use. However, the worm 310 and/or the worm wheel 312 may be formed of another material capable of withstanding heats produced by the worm gear assembly 304 in other examples. In some examples, through the change of the material of the worm wheel 312 and the worm 310 and the adjustment of the angle of the worm wheel 312 and the worm 310, the self-locking ability is improved. In some such examples, user satisfaction is improved.

Figure 4:
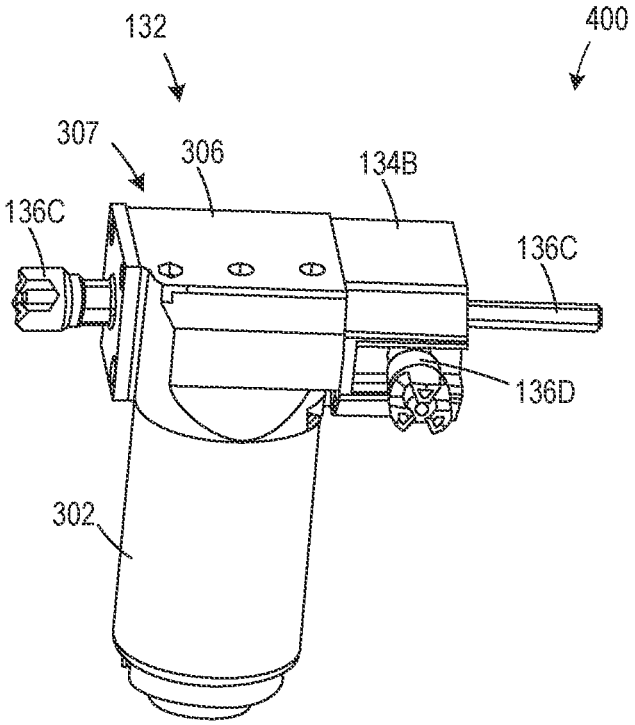
FIG. 4 illustrates a portion of the example height adjustment system of FIGS. 1A-3B including the example drive system, an interconnection example gearbox, and example transmission shafts structured in accordance with teachings of this disclosure to transmit rotational motion to three legs simultaneously.

FIG. 4 is a perspective view of an example sub-assembly 400 of the height adjustment system 130, including the example drive system 132, the example interconnection gearbox 134B, the example output transmission shaft 136C, and the example interconnection transmission shaft 136D. The example motor 302 of the drive system 132 serves as an output end. The output transmission shaft 136C extends through the example bore 316 of the worm wheel 310 and through the interconnection gearbox 134B. The interconnection gearbox 134B is coupled to the drive system 132.

Figure 5:
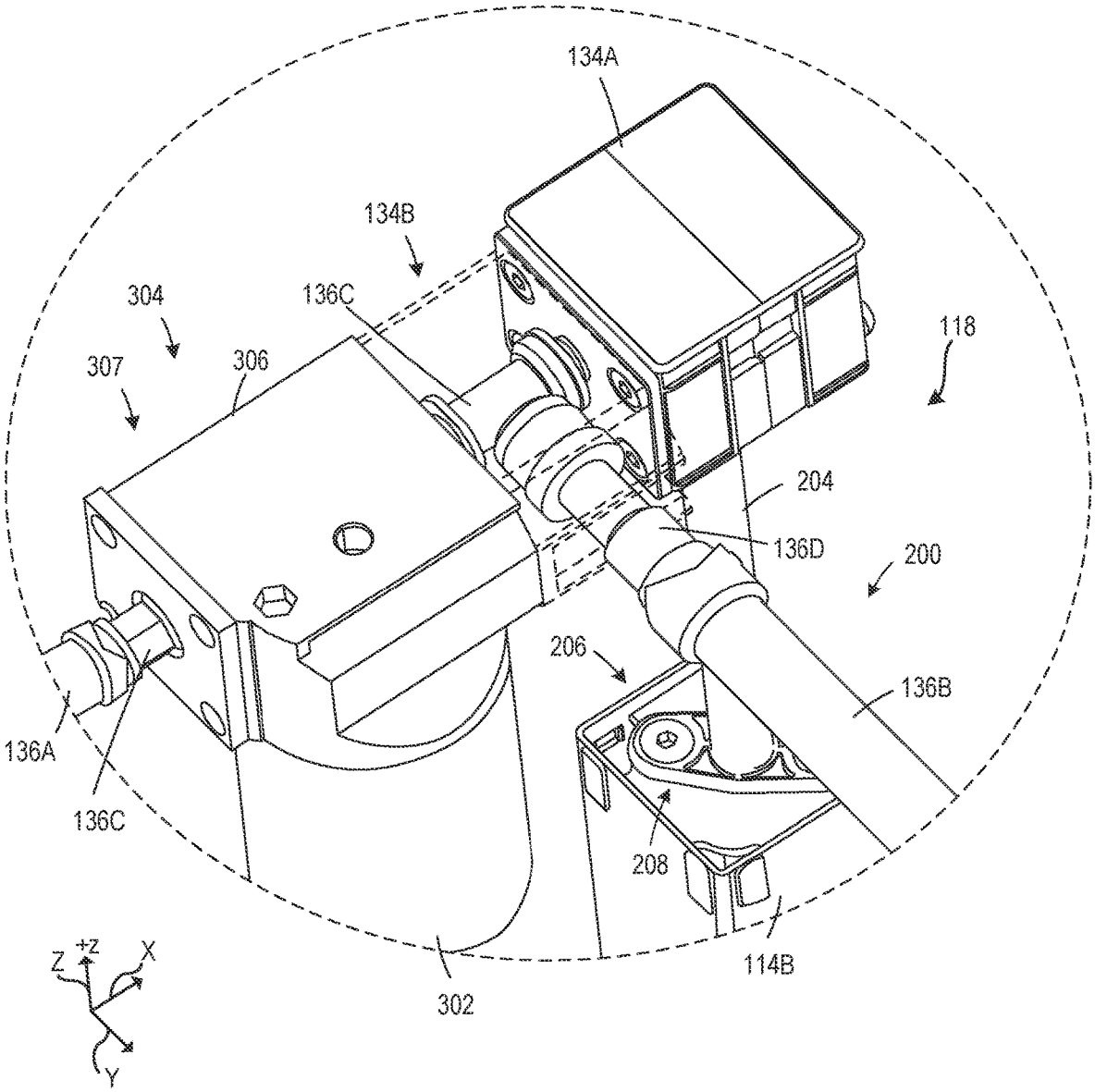
FIG. 5 is part perspective view of the height adjustment system.

FIG. 5 is a partial perspective view of the height adjustment desk 100 illustrating the example drive system 132 and the example interconnection gearbox 134B adjacent the point of interconnection 118. The interconnection gearbox 134B is coupled between the worm gear assembly 304 within the cover 306 and the leg gearbox 134A at the interconnection point 118. The second transmission shaft 136B extends from the interconnection gearbox 134B and couples to the worm wheel 312 via the output transmission shaft 136C and the interconnection transmission shaft 136D. The first transmission shaft 136A is coupled to the worm wheel 312 via the output transmission shaft 136C. A respective leg gearbox 134A is connected to the top of each actuator 200. The gearboxes 134A, B are provided with helical teeth, which are structured to change a direction of rotation when the gearboxes 134A, 134B connect to the transmission shafts 136A, 136B, 136C or the threaded rods 204 of the actuators 200.

The drive system 132, through the rotation of the worm 310, which realizes the rotation of the worm wheel 312, drives the synchronous rising and falling of the three telescoping legs 114A-C. Specifically, the drive system 132 drives the rotation of the worm 310, the rotation of which drives the rotation of the worm wheel 312. The rotation of the worm wheel 312 drives the rotation of the output transmission shaft 136C. The rotation of the output transmission shaft 136C drives the leg gearbox 134A at the interconnection point 118, the rotation of the first transmission shaft 136A (e.g., which drives the leg gearbox 134A at the first endpoint 116A), and the rotation of the interconnection transmission shaft 136D through the interconnection gearbox 134B. The rotation of the interconnection transmission shaft 136D drive the rotation of the second transmission shaft 136B, which drives the leg gearbox 134A at the second endpoint 116B. The leg gearboxes 134A change a direction of rotation of the transmission shafts 136A, 136B, 136D to drive rotation of the threaded rods 204 with the telescoping legs 114A-C. As the threaded rods 204 rotate, the threaded nuts 206 drive the threaded rods 204 in a z-direction, causing the upper sections 114U of the telescoping legs 114A-C to raise or lower (e.g., depending on the direction). Therefore, through the actions of the gearboxes 134A-B and the transmission shafts 136A-D, the drive system 132 drives the telescoping legs 114A-C to raise or lower relative to the z-axis, causing the desktop 104 to raise or lower, respectively.

Figure 6:
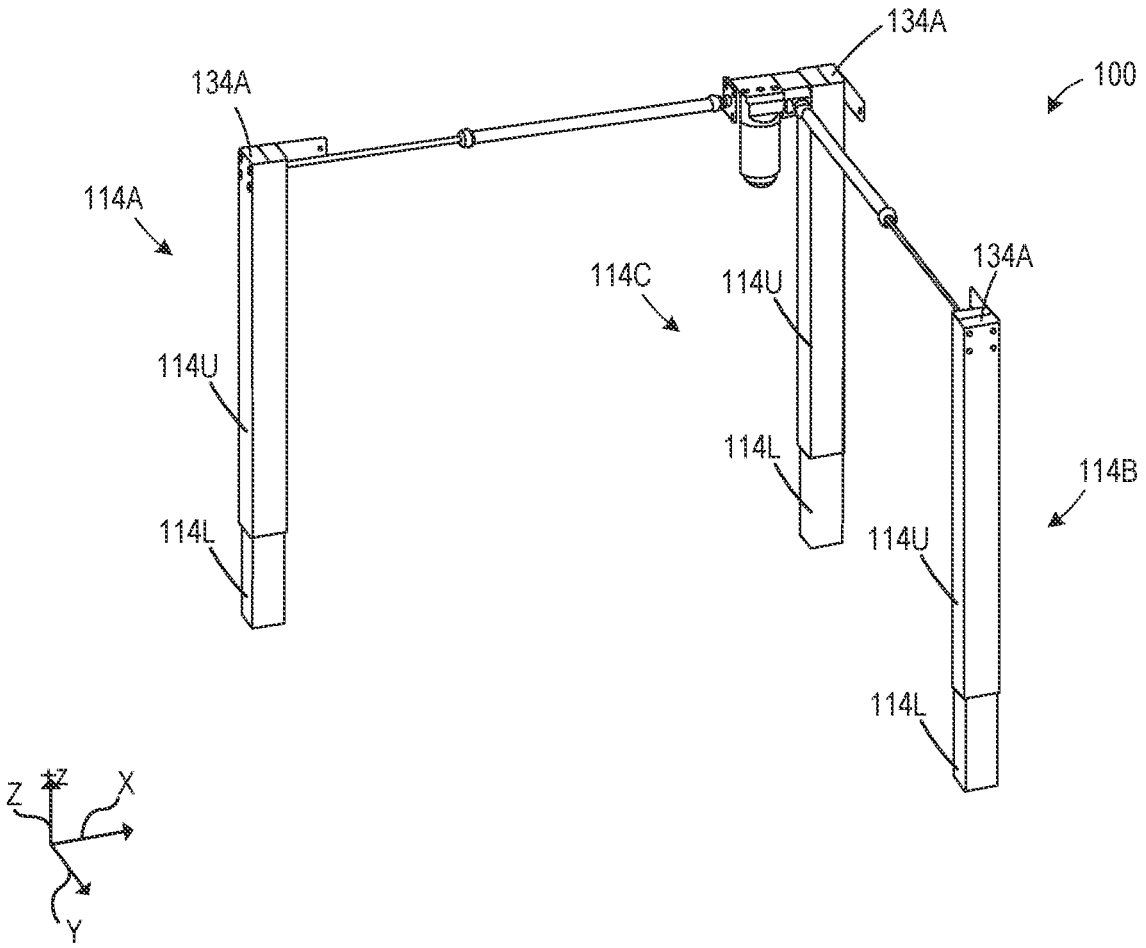
FIG. 6 is another isometric view of the example height adjustment system of FIGS. 1A-1C and 2 with full telescopic legs in accordance with teachings of this disclosure.

FIG. 6 illustrates a perspective view of the height adjustment system 130 of FIG. 2 and the upper sections 114U of the telescoping legs 114A-C implementing example covers for respective actuators 200. The upper sections 114U of FIG. 6 are coupled to respective leg gearboxes 134A at the top ends 120 of the telescoping legs 114A-C. The upper sections 114U extend in the −z direction and overlap with respective lower sections 114L. In some examples, the upper sections 114U provide a safety feature to cover the lead-screw assembly 202. In some examples, the upper sections 114U are structured such that they continue to overlap with respective lower sections 114L at any given height of the height adjustable desk 100.

The height adjustable desk 100 is height adjustable by lengthening or shortening the height adjustable legs 114A-C, enabling raising and lowering of the desktop 104. As noted above, the desktop 104 may be a one-piece desktop 104. However, to facilitate installation and transportation needs and to meet different use environments of users, the desktop 104 may be provided in a spliced form that includes three splicing sections 104A, 104B, 104C. Thus, the height adjustable desk 100 as disclosed herein can also be re-configurable. In the illustrated example of FIGS. 1A-1C, the height adjustable desk 100 is longer along the x-axis, and includes an extension along the y-axis. That is, a first splicing section 104A and a second splicing section 104B form the longer side and a third splicing section 104C implements the extension. However, the crossbars 140 of the base frame 102 are telescoping crossbars 140 that include an inner crossbar 140A nesting within two outer crossbars 140B such that the length of the crossbar 140 and, resultingly, the base frame 102, can be adjusted to fit various length desktops.

Figure 7A:
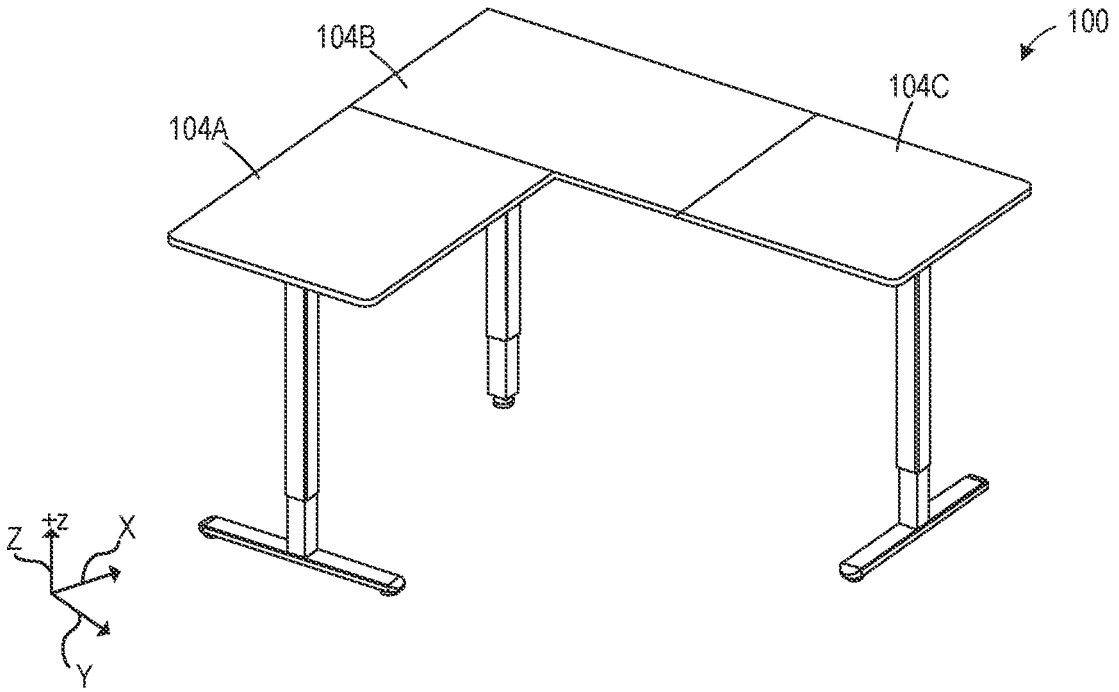
FIGS. 7A and 7B illustrate another example configuration of the height adjustable desk of FIGS. 1A-6 in accordance with teachings of this disclosure.
Figure 7B:
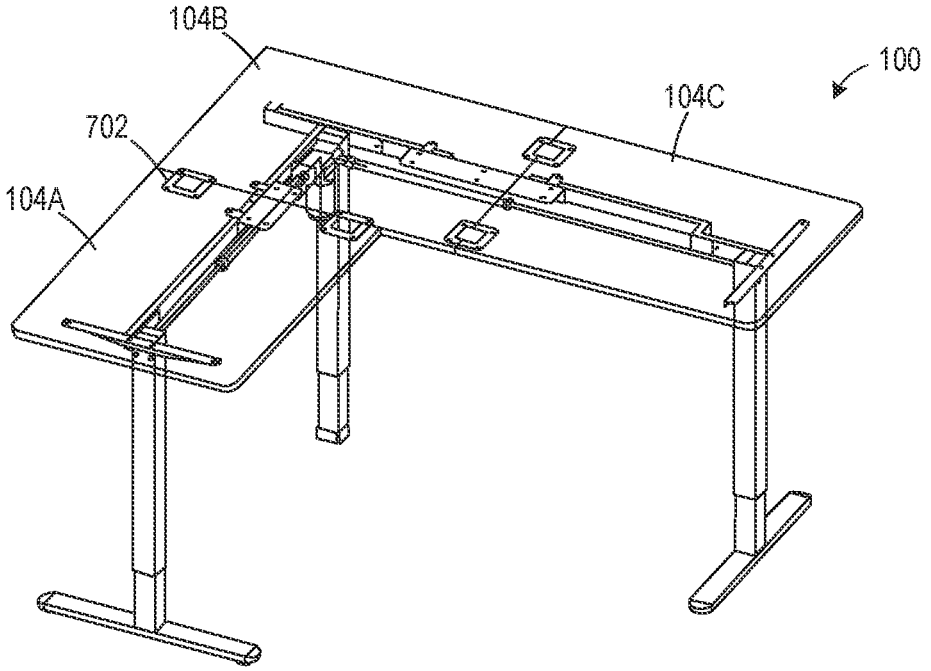

FIGS. 7A and 7B illustrate another example implementation example configuration of the height adjustable desk 100. As illustrated in FIG. 7A, the desktop 104 is a spliced structure, including three example three splicing sections 104A, 104B, 104C. The splicing sections 104A, 104B, 104C are rectangular and can be spliced along a first direction (e.g., along the x-axis) or a second direction (e.g., along the y-axis) of the L-shape. Such a structural arrangement enables improved installation and transportation, and also enables installation use in a variety of environments. In some examples, the three splicing sections 104A, 104B, 104C can also be arranged to have approximately the same shape to facilitate manufacture and machining.

In the illustrated example of FIGS. 7A-7B, the height adjustable desk 100 is longer along the y-axis, and includes an extension along the x-axis. That is, the third splicing section 104C and the second splicing section 104B form the longer side and the first splicing section 104A implements the extension. Typically, a user may be positioned to face the longer side of the height adjustable desk 100, and utilize the extension side for additional space. However, the user can position themselves at the height adjustable desk 100 in any way they desire.

As illustrated in FIG. 7B, the height adjustable desk 100 may include example connecting brackets 702 to connect two adjacent splicing sections 104A, 104B, 104C. In some examples, the connecting brackets 702 may be positioned on either side of the splicing sections 104A, 104B, 104C (e.g., the top surface 108 or the bottom surface 110). The connecting brackets 702 may be a connecting board with holes provided on the connecting bracket 20, which is fixed by fasteners; it may also be a connecting board whose length directly covers the splicing sections 104A, 104B, 104C on either side of the splicing surface, or any other suitable connection forms. With such structural arrangement, not only the installation is made easier, but also the stability and reliability of the desktop 104 is improved.

FIGS. 8-11 illustrate top down views of the example base frame 102 and example height adjustment system 130 as configured in FIGS. 1A-6.

Figure 8:
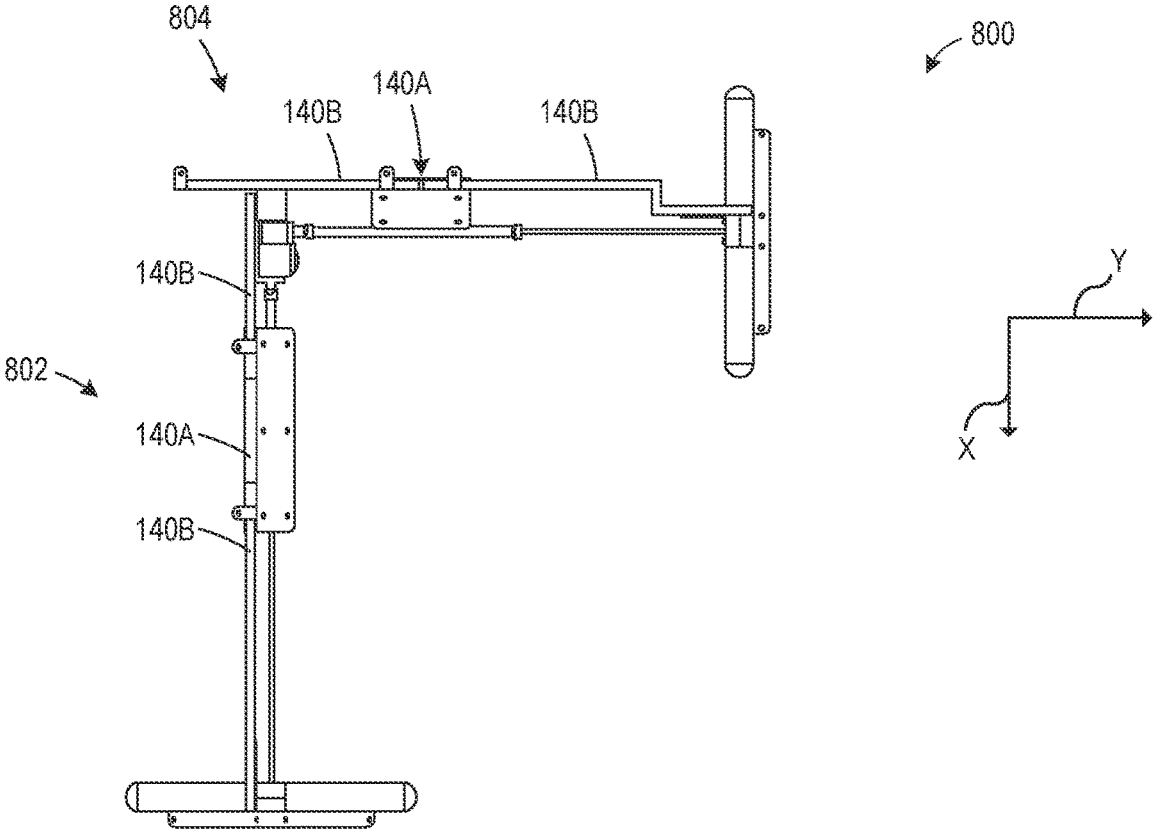
FIGS. 8-11 are top down views of different configurations of the example desk frame and the example height adjustable system, illustrating the configurability of the example height adjustable desk in accordance with teachings of this disclosure.

FIG. 8 illustrates a top down view of an example implementation 800 of the example base frame 102 and example height adjustment system 130 as configured in FIGS. 1A-6. An example long portion 802 is positioned along the x-axis and an example extension portion 804 is positioned along the y-axis. The long portion 802 includes an example crossbar 140 in an extended form such that an inner crossbar 140A is exposed. The extension portion 804 includes an example crossbar 140 in a retracted form such that an inner crossbar 140A is nested within outer crossbars 140B. The extension is positioned towards a right-hand side of a user, for example.

Figure 9:
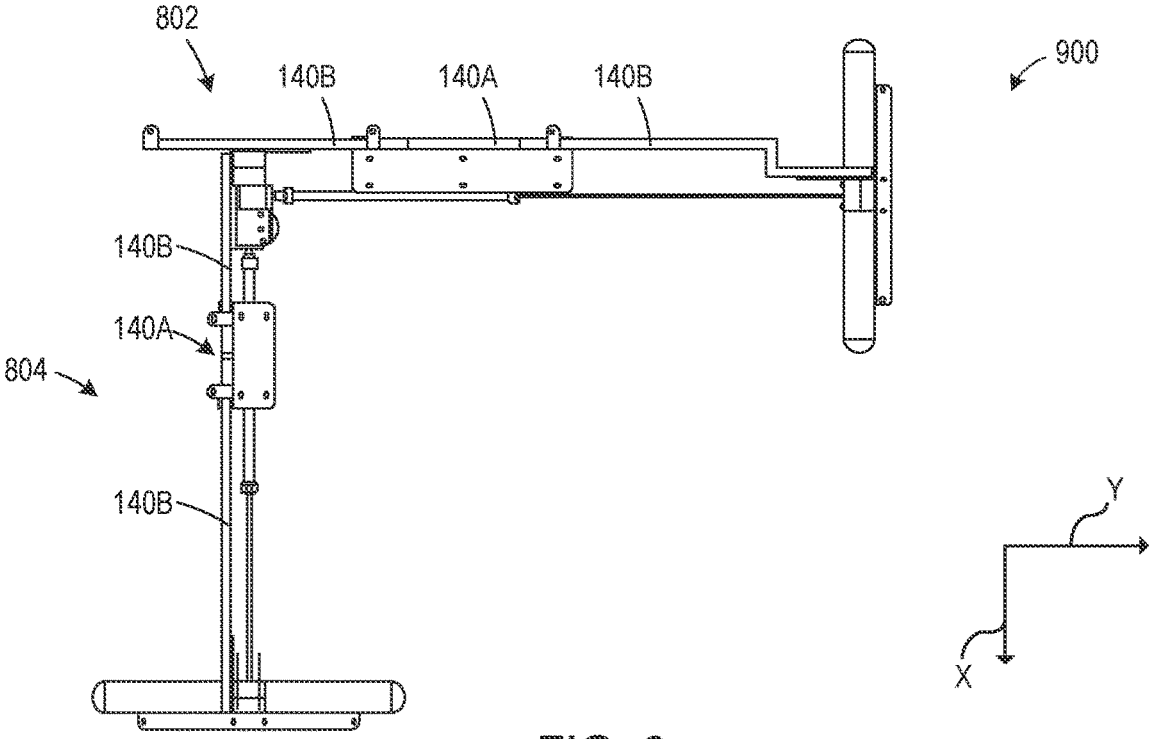

FIG. 9 illustrates a top down view another example implementation 900 of the example base frame 102 and example height adjustment system 130 as configured in FIGS. 7A-7B. The example long portion 802 is positioned along the x-axis and an example extension portion 804 is positioned along the y-axis. The long portion 802 includes an example crossbar 140 in an extended form such that an inner crossbar 140A is exposed. The extension portion 804 includes an example crossbar 140 in a retracted form such that an inner crossbar 140A is nested within outer crossbars 140B. The extension is positioned towards a right-hand side of a user, for example.

Figure 10:
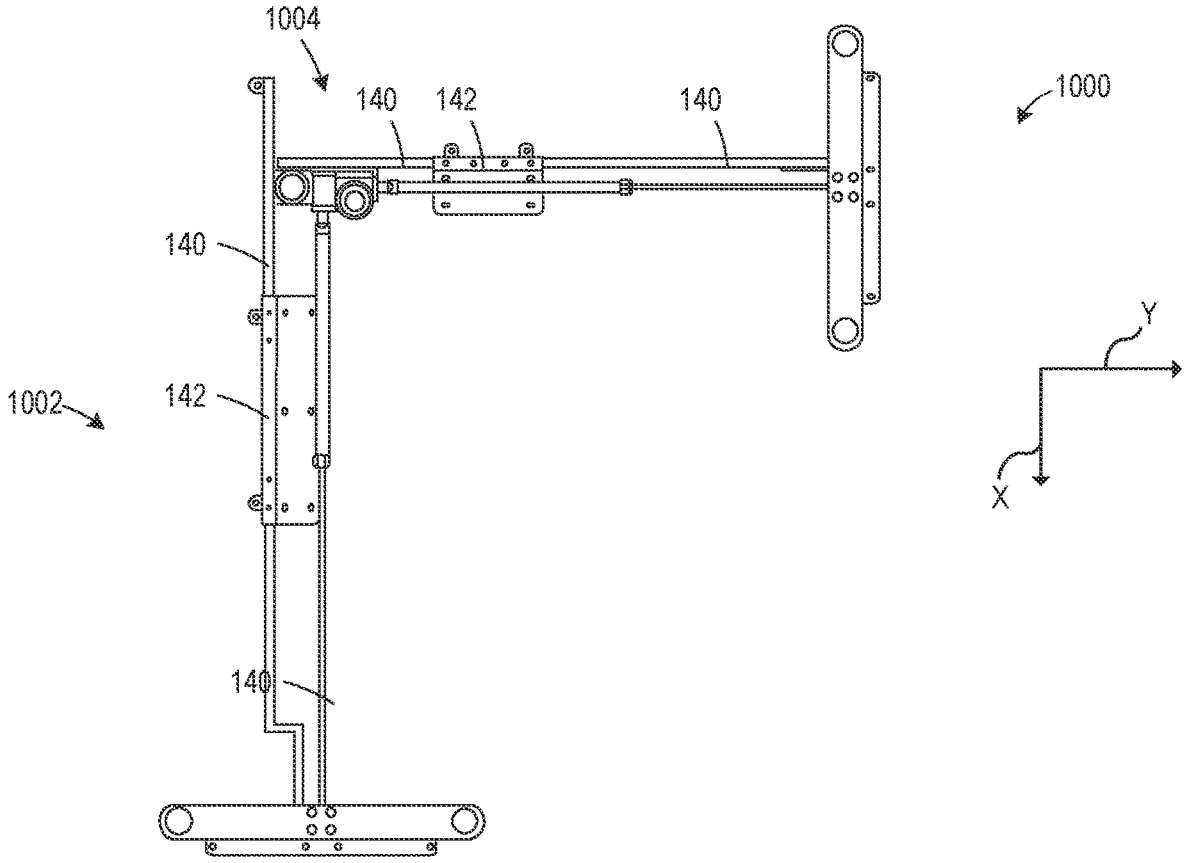

FIG. 10 illustrates a top down view of an example implementation 1000 of the example base frame 102 and example height adjustment system 130. The implementation 1000 is similar to the implementation 800 of FIG. 8. However, the implementation 1000 of FIG. 10 includes examples crossbars 140 connected by example crossbar connectors 142 (e.g., as opposed to or in addition to the telescoping crossbars 140A, 140B. An example long portion 1002 is positioned along the x-axis and an example extension portion 1004 is positioned along the y-axis. The long portion 1002 includes a first example cross bar 140 and a second example crossbar 140 coupled by an example first crossbar connector 142. The extension portion 1004 includes an example third crossbar 140 and an example fourth crossbar 140 coupled by an example second crossbar connector 142, which is shorter than the first crossbar connector. The extension 1004 is positioned towards a right-hand side of a user, for example.

Figure 11:
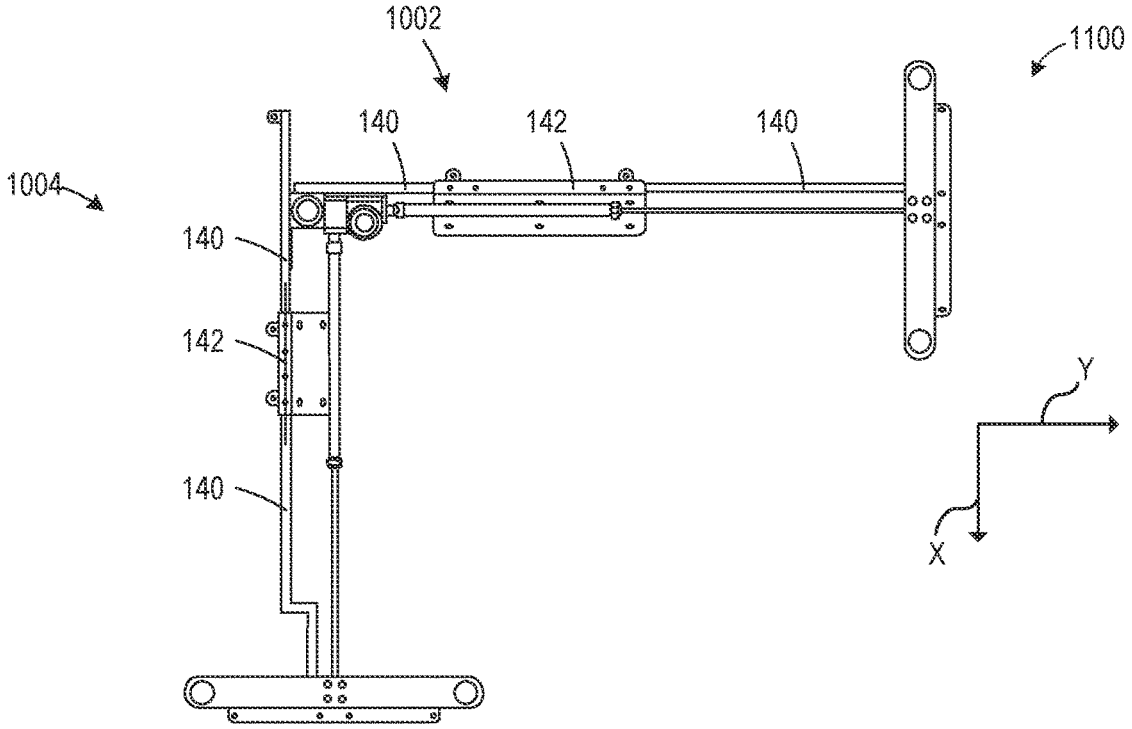

FIG. 11 illustrates a top down view of the example base frame 102 and example height adjustment system 130 in another example configuration. The extension is positioned towards a right-hand side of a user and the drive system 132 is positioned along the y-axis, for example.

FIG. 11 illustrates a top down view of an example implementation 1100 of the example base frame 102 and example height adjustment system 130, which is reconfigured relative to FIG. 10. The long portion 1002 of FIG. 11 is positioned along the y-axis and the extension portion 1004 is positioned along the x-axis. The long portion 1002 includes the third crossbar 140 and the fourth crossbar 140 coupled by the first crossbar connector 142, which is longer than the second crossbar connector. The extension 1004 includes the first cross bar 140 and the second crossbar 140 coupled by the second crossbar connector 142. The extension 1004 is positioned towards a left-hand side of a user.

The splicing capabilities of the desktop 104 and the structure of the base frame 102 enables different configurations that allow a user to choose how to build the height adjustable desk 100. Further, the height adjustable desk 100 allows the user to adjust a height 126 of the height adjustable desktop 100 at any given moment.

Figure 12:
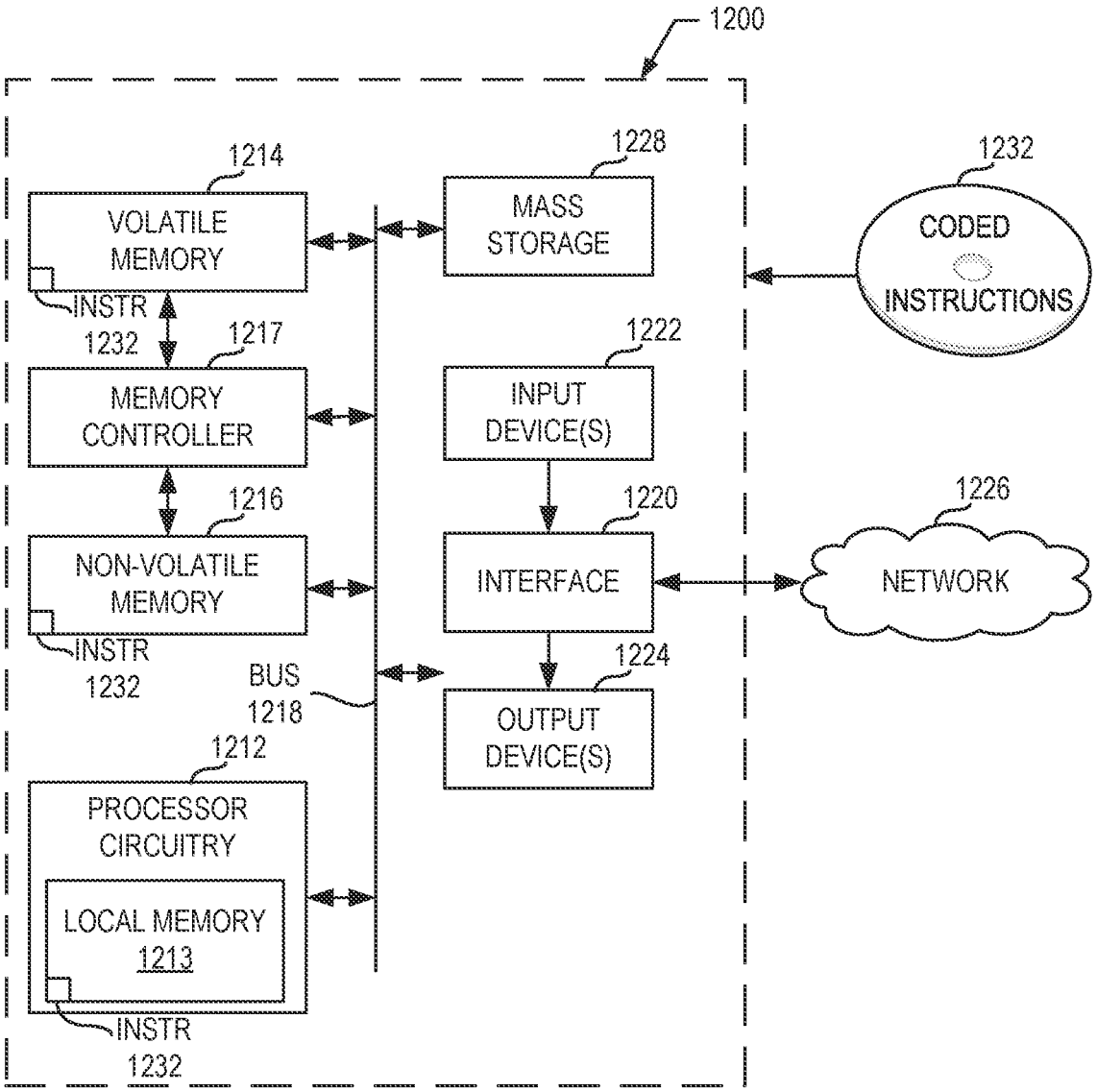
FIG. 12 is a block diagram of an example processing platform including processor circuitry structured to execute example machine readable instructions to implement the controller of FIG. 1A-1C.

FIG. 12 is a block diagram of an example processor platform 1200 structured to execute and/or instantiate machine readable instructions and/or operations to implement the controller 138 of FIGS. 1A-1C. The processor platform 1200 can be, for example, a server, a personal computer, a workstation, a self-learning machine (e.g., a neural network), a mobile device (e.g., a cell phone, a smart phone, a tablet such as an iPad™), a personal digital assistant (PDA), an Internet appliance, a gaming console, a set top box, or other wearable device, or any other type of computing device.

The processor platform 1200 of the illustrated example includes processor circuitry 1212. The processor circuitry 1212 of the illustrated example is hardware. For example, the processor circuitry 1212 can be implemented by one or more integrated circuits, logic circuits, FPGAs, microprocessors, CPUs, GPUs, DSPs, and/or microcontrollers from any desired family or manufacturer. The processor circuitry 1212 may be implemented by one or more semiconductor based (e.g., silicon based) devices.

The processor circuitry 1212 of the illustrated example includes a local memory 1213 (e.g., a cache, registers, etc.). The processor circuitry 1212 of the illustrated example is in communication with a main memory including a volatile memory 1214 and a non-volatile memory 1216 by a bus 1218. The volatile memory 1214 may be implemented by Synchronous Dynamic Random Access Memory (SDRAM), Dynamic Random Access Memory (DRAM), RAMBUS® Dynamic Random Access Memory (RDRAM®), and/or any other type of RAM device. The non-volatile memory 1216 may be implemented by flash memory and/or any other desired type of memory device. Access to the main memory 1214, 1216 of the illustrated example is controlled by a memory controller 1217.

The processor platform 1200 of the illustrated example also includes interface circuitry 1220. The interface circuitry 1220 may be implemented by hardware in accordance with any type of interface standard, such as an Ethernet interface, a universal serial bus (USB) interface, a Bluetooth® interface, a near field communication (NFC) interface, a Peripheral Component Interconnect (PCI) interface, and/or a Peripheral Component Interconnect Express (PCIe) interface.

In the illustrated example, one or more input devices 1222 are connected to the interface circuitry 1220. The input device(s) 1222 permit(s) a user to enter data and/or commands into the processor circuitry 1212. The input device(s) 1222 can be implemented by, for example, an audio sensor, a microphone, a camera (still or video), a keyboard, a button, a mouse, a touchscreen, a track-pad, a trackball, an isopoint device, and/or a voice recognition system.

One or more output devices 1224 are also connected to the interface circuitry 1220 of the illustrated example. The output device(s) 1224 can be implemented, for example, by display devices (e.g., a light emitting diode (LED), an organic light emitting diode (OLED), a liquid crystal display (LCD), a cathode ray tube (CRT) display, an in-place switching (IPS) display, a touchscreen, etc.), a tactile output device, a printer, and/or speaker. The interface circuitry 1220 of the illustrated example, thus, typically includes a graphics driver card, a graphics driver chip, and/or graphics processor circuitry such as a GPU.

The interface circuitry 1220 of the illustrated example also includes a communication device such as a transmitter, a receiver, a transceiver, a modem, a residential gateway, a wireless access point, and/or a network interface to facilitate exchange of data with external machines (e.g., computing devices of any kind) by a network 1226. The communication can be by, for example, an Ethernet connection, a digital subscriber line (DSL) connection, a telephone line connection, a coaxial cable system, a satellite system, a line-of-site wireless system, a cellular telephone system, an optical connection, etc.

The processor platform 1200 of the illustrated example also includes one or more mass storage devices 1228 to store software and/or data. Examples of such mass storage devices 1228 include magnetic storage devices, optical storage devices, floppy disk drives, HDDs, CDs, Blu-ray disk drives, redundant array of independent disks (RAID) systems, solid state storage devices such as flash memory devices and/or SSDs, and DVD drives.

The machine readable instructions 1232, which may be implemented by the machine readable instructions may be stored in the mass storage device 1228, in the volatile memory 1214, in the non-volatile memory 1216, and/or on a removable non-transitory computer readable storage medium such as a CD or DVD.

From the foregoing, it will be appreciated that example methods, apparatus, systems, and articles of manufacture have been disclosed that provide lifting mechanisms for tables. Example methods, apparatus, systems, and articles of manufacture to synchronously adjust a height of three lifting columns through one lift drive assembly are disclosed herein. Further examples and combinations thereof include the following:

Example 1 includes a height adjustable table, comprising three legs, each of the three legs including an upper section, a lower section, and an actuator; a connection system to couple the three legs; and a height adjustment system including drive system; a first gearbox coupled to the drive system; second gearboxes coupled to respective ones of the actuators, the first gearbox and the second gearboxes to change a transmission direction; and transmission shafts connected to the drive system and to the first and second gearboxes, wherein the drive system is configured to drive the transmission shafts to drive the legs together to rise and fall, and wherein the drive system includes a motor, a worm connected to the motor, and a worm wheel engaged with the worm.

Example 2 includes the height adjustable table of example 1, wherein a transmission ratio of the worm wheel to the worm is 20:1.

Example 3 includes the height adjustable table of any one of claims 1-2, wherein the worm and the worm wheel form a worm gear, and wherein the worm gear is self-locking.

Example 4 includes the height adjustable table of any one of claims 1-3, wherein the worm is formed of steel, and the worm wheel is formed of a high-performance composite material.

Example 5 includes the height adjustable table of any one of claims 1-4, wherein the first gearbox includes helical teeth, the helical teeth to engage with a respective one of the transmission shafts to change the transmission direction.

Example 6 includes the height adjustable table of any one of claims 1-5, wherein the second gearboxes include helical teeth, the helical teeth to engage with respective ones of the transmission shafts to change the transmission direction.

Example 7 includes the height adjustable table of any one of claims 1-6, wherein each of the three legs includes a first end, a second, and a length defined by a distance from the first end to the second end.

Example 8 includes the height adjustable table of any one of claims 1-7, wherein each of the three legs includes a support base coupled to a respective second end.

Example 9 includes the height adjustable table of any one of claims 1-8, wherein the connection system includes a connecting bracket coupled ones of the upper sections of the legs, the height adjustable table further including a tabletop coupled to the connecting bracket.

Example 10 includes the height adjustable table of any one of claims 1-9, wherein the tabletop is a spliced structure, the tabletop including a first tabletop section coupled to a second tabletop section and a third tabletop section coupled to the first tabletop section or the second tabletop section.

Example 11 includes the height adjustable table of any one of claims 1-10, wherein the tabletop sections are rectangular and spliced along a first direction or a second direction to form an L-shape.

Example 12 includes the height adjustable table of any one of claims 1-11, further including tabletop brackets, the tabletop brackets to coupled ones of the tabletop sections.

Example 13 includes the height adjustable table of any one of claims 1-12, wherein the motor is a silent motor.

Example 14 includes a system to adjust a height of a desk, the system comprising: three actuators positioned vertically relative to a ground, each of the actuators including a portion of a telescoping leg, a threaded nut coupled to the portion of the telescoping leg, and a threaded rod rotatably coupled to the threaded nut and extending from the portion of the telescoping leg; three leg gearboxes, each leg gearbox coupled to a respective actuator, wherein the leg gearboxes are configured to change horizontal transmission directions to a vertical transmission directions; an interconnection gearbox configured to change a first one of the horizontal directions to a second one of the horizontal directions; a drive system, the drive system including a motor and a worm gear; and transmission shafts rotatably coupled to the drive system, the leg gearboxes, and the interconnection gearbox, wherein the drive system is configured to drive the transmission shafts to drive, collectively, the threaded rods to rotate, the rotation of the threaded rods to cause the threaded rods to slide relative to the threaded nuts to raise or lower the threaded rods.

Example 15 includes the system of example 14, wherein the worm gear includes a worm and a worm wheel, and wherein a transmission ratio of the worm wheel to the worm is 20:1.

Example 16 includes the system of any one of examples 14-15, wherein the worm is formed of steel, and the worm wheel is formed of a high-performance composite material.

Example 17 includes the system of any one of examples 14-16, wherein the worm gear is self-locking.

Example 18 includes a height adjustable desk comprising: structural means to define the height adjustable desk, the structural means including telescoping legs and a desktop coupled to the telescoping legs; actuator means configured to extend or retract the telescoping legs; driving means to provide rotational motion, the driving means including one electric motor; gear means to change a direction of the rotational motion; and transmission means to transmit the rotational motion between components of the height adjustable desk, the transmission means coupled to the actuators, the driving means, and the gear means, wherein the driving means are to drive, through the gear means and the transmission means, the actuator means to lengthen or shorten the telescoping legs, the lengthening or the shortening of the telescoping legs to change a height of the height adjustable desk.

Example 19 includes the height adjustable desk of example 18, wherein the driving means include a work gear assembly coupled to the motor to provide the rotational motion to the transmission means, the worm gear assembly including a worm wheel meshed with a worm.

Example 20 includes the height adjustable desk of any one of examples 18-19, wherein the worm is formed of steel, and the worm wheel is formed of a high-performance composite material.

It is noted that this patent claims priority from Chinese Patent Application Number 202221765766.5, which was filed on Jul. 8, 2022, and is hereby incorporated by reference in its entirety.

Although certain example systems, methods, apparatus, and articles of manufacture have been disclosed herein, the scope of coverage of this patent is not limited thereto. On the contrary, this patent covers all systems, methods, apparatus, and articles of manufacture fairly falling within the scope of the claims of this patent.

The following claims are hereby incorporated into this Detailed Description by this reference, with each claim standing on its own as a separate embodiment of the present disclosure.

What is claimed is:

1. A height adjustable table, comprising:

three legs, each of the three legs including an upper section, a lower section, and an actuator;

a connection system to couple the three legs; and a height adjustment system including:

a drive system including a drive system housing, one motor, a worm connected to the motor, a worm wheel engaged with the worm, and an output shaft, the drive system to drive the output shaft;

a first gearbox coupled to the drive system, the first gearbox to convert rotation of the output shaft in a first horizontal transmission direction to rotation of an interconnection shaft in a second horizontal transmission direction, the first gearbox including a gearbox housing attached to the drive system housing, the output shaft extending through the first gearbox;

second gearboxes separate from the first gearbox, the second gearboxes coupled to respective ones of the actuators, each second gearbox to correspond to a respective leg, each second gearbox to change one of the first horizontal transmission direction or the second horizontal transmission direction to a vertical transmission direction; and transmission shafts, each one of the transmission shafts connected to one of the output shaft or the interconnection shaft, and one of the second gearboxes, wherein the drive system is configured to drive the transmission shafts to drive the legs together to rise and fall.

2. The height adjustable table of claim 1, wherein a transmission ratio of the worm wheel to the worm is 20:1.

3. The height adjustable table of claim 1, wherein the worm and the worm wheel form a worm gear, and wherein the worm gear is self-locking.

4. The height adjustable table of claim 1, wherein the worm is formed of steel, and the worm wheel is formed of a high-performance composite material.

5. The height adjustable table of claim 1, wherein the first gearbox includes helical teeth, the helical teeth to engage with the output shaft to change the first horizontal transmission direction to the second horizontal transmission direction.

6. The height adjustable table of claim 1, wherein the second gearboxes include helical teeth, the helical teeth to engage with respective ones of the output shaft, and the transmission shafts to change respective ones of the first horizontal transmission direction and the second horizontal transmission direction to the vertical transmission direction.

7. The height adjustable table of claim 1, wherein each of the three legs includes a first end, a second end, and a length defined by a distance from the first end to the second end.

8. The height adjustable table of claim 7, wherein each of the three legs includes a support base coupled to a respective second end.

9. The height adjustable table of claim 1, wherein the connection system includes a connecting bracket coupled to ones of the upper sections of the legs, the height adjustable table further including a tabletop coupled to the connecting bracket.

10. The height adjustable table of claim 9, wherein the tabletop is a spliced structure, the tabletop including a first tabletop section coupled to a second tabletop section and a third tabletop section coupled to the first tabletop section or the second tabletop section.

11. The height adjustable table of claim 10, wherein the first, second, and third tabletop sections are rectangular and spliced along a first direction or a second direction to form an L-shape.

12. The height adjustable table of claim 10, further including tabletop brackets, the tabletop brackets coupling ones of the first, second, and third tabletop sections.

13. The height adjustable table of claim 1, wherein the motor has a speed reduction ratio to reduce rotation speed of the motor and reduce noise emitted by the motor.

14. A system to adjust a height of a desk, the system comprising:

three actuators positioned vertically relative to a ground, each of the actuators including a portion of a telescoping leg, a threaded nut coupled to the portion of the telescoping leg, and a threaded rod rotatably coupled to the threaded nut and extending from the portion of the telescoping leg;

three leg gearboxes, each leg gearbox coupled to a respective actuator, wherein the leg gearboxes are configured to change respective horizontal transmission directions to a vertical transmission direction;

a drive system including a drive system housing, one motor, a worm gear assembly, and an output shaft;

an interconnection gearbox configured to convert rotation of the output shaft in a first one of the horizontal transmission directions to rotation of an interconnection shaft in a second one of the horizontal transmission directions, the interconnection gearbox including an interconnection gearbox housing attached to the drive system housing, the output shaft extending through the interconnection gearbox; and transmission shafts rotatably coupled to the drive system, the leg gearboxes, and the interconnection gearbox, wherein the drive system is configured to drive the transmission shafts to drive, collectively, the threaded rods to rotate, the rotation of the threaded rods to cause the threaded rods to slide relative to the threaded nuts to raise or lower the threaded rods.

15. The system of claim 14, wherein the worm gear assembly includes a worm and a worm wheel, and wherein a transmission ratio of the worm wheel to the worm is 20:1.

16. The system of claim 15, wherein the worm is formed of steel, and the worm wheel is formed of a high-performance composite material.

17. The system of claim 16, wherein the worm gear assembly is self-locking.

18. The height adjustable table of claim 1, wherein the three legs are arranged in an L-shaped format to provide support for an L-shaped tabletop.

19. The height adjustable table of claim 9, the tabletop includes three tabletop sections, and wherein each leg is coupled to a respective tabletop section of the tabletop sections.

20. The system of claim 14, wherein the three actuators are positioned such that a first direction defined from a first actuator of the actuators to a second actuator of the actuators is non-parallel relative to a second direction defined from the second actuator of the actuators to a third actuator of the actuators.

21. The height adjustable table of claim 1, wherein one of the second gearboxes is attached to the first gearbox and receives the output shaft.

* * * * *